US008623796B2

(12) United States Patent
Drake et al.

(10) Patent No.: US 8,623,796 B2
(45) **Date of Patent: *Jan. 7, 2014**

(54) OIL-IN-OIL COMPOSITIONS AND METHODS OF MAKING

(75) Inventors: Evelyn N. Drake, Bernardsville, NJ (US); Samuel C. Bainbridge, Philadelphia, PA (US); David A. Blain, Cherry Hill, NJ (US); James T. Carey, Medford, NJ (US); Angela S. Galiano-Roth, Mullica Hill, NJ (US); L. Oscar Farng, Lawrenceville, NJ (US); Suzzy C. Ho, Princeton, NJ (US); David K. Prendergast, Chester, PA (US); Martin N. Webster, Pennington, NJ (US); Margaret M. Wu, Skillman, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 180 days.

This patent is subject to a terminal disclaimer.

(21) Appl. No.: 13/117,580

(22) Filed: May 27, 2011

(65) Prior Publication Data

US 2012/0302473 A1 Nov. 29, 2012

(51) Int. Cl.
*C10M 129/78* (2006.01)

(52) U.S. Cl.
USPC ..... 508/459

(58) Field of Classification Search
USPC ..... 508/110, 459
See application file for complete search history.

(56) References Cited

U.S. PATENT DOCUMENTS

| | | | |
|---|---|---|---|
| 2,575,195 | A | 11/1951 | Smith, Jr. |
| 2,575,196 | A | 11/1951 | Smith, Jr. |
| 3,016,353 | A | 1/1962 | Matuszak |
| 3,149,178 | A | 9/1964 | Hamilton et al. |
| 3,316,177 | A | 4/1967 | Dorer, Jr. |
| 3,326,804 | A | 6/1967 | Hu |
| 3,382,291 | A | 5/1968 | Brennan |
| 3,742,082 | A | 6/1973 | Brennan |
| 3,769,363 | A | 10/1973 | Brennan |
| 3,780,128 | A | 12/1973 | Shubkin |

(Continued)

FOREIGN PATENT DOCUMENTS

| | | |
|---|---|---|
| EP | 0613873 | 9/1994 |
| WO | 9623751 | 8/1996 |

(Continued)

*Primary Examiner* — Taiwo Oladapo
(74) *Attorney, Agent, or Firm* — Robert A. Migliorini

(57) ABSTRACT

This invention is directed to a lubricant composition that is comprised of a continuous phase and a discontinuous phase, i.e., a two phase lubricant composition. The continuous phase and the discontinuous phase of the lubricant of this invention are oil or oil type compositions that are essentially insoluble in one another. The lubricant composition is comprised of a continuous phase base oil that is comprised of a low viscosity Group II, III, IV or GTL base stock or a blend of at least two of the Group II, III, IV and GTL base stocks, optionally including a low viscosity Group V base stock, with the continuous phase base oil having, independently, a viscosity of from 1 to 100 cSt at 100° C. The lubricant composition is further comprised of a discontinuous phase that is comprised of an ester composition having a mean average droplet size of from 0.01 microns to 20 microns, in which the ester composition is comprised of an ester compound having no ether linkages.

19 Claims, 7 Drawing Sheets

EHL Film Thickness of a 0.5 wt % Dispersion of PTE in PAO-8 in Comparison to Pure PAO-8 and Pure PTE

(56) References Cited

U.S. PATENT DOCUMENTS

| | | | | |
|---|---|---|---|---|
| 3,876,720 | A | 4/1975 | Heilman et al. | |
| 4,068,056 | A | 1/1978 | Engel et al. | |
| 4,149,178 | A | 4/1979 | Estes | |
| 4,172,855 | A | 10/1979 | Shubkin et al. | |
| 4,239,930 | A | 12/1980 | Allphin et al. | |
| 4,367,352 | A | 1/1983 | Watts, Jr. et al. | |
| 4,413,156 | A | 11/1983 | Watts, Jr. et al. | |
| 4,434,408 | A | 2/1984 | Baba et al. | |
| 4,440,657 | A | 4/1984 | Metro et al. | |
| 4,827,064 | A | 5/1989 | Wu | |
| 4,827,073 | A | 5/1989 | Wu | |
| 4,910,355 | A | 3/1990 | Shubkin et al. | |
| 4,914,254 | A | 4/1990 | Pelrine | |
| 4,926,004 | A | 5/1990 | Pelrine et al. | |
| 4,956,122 | A | 9/1990 | Watts et al. | |
| 4,967,032 | A | 10/1990 | Ho et al. | |
| 5,068,487 | A | 11/1991 | Theriot | |
| 5,075,383 | A | 12/1991 | Migdal et al. | |
| 5,087,788 | A | 2/1992 | Wu | |
| 5,688,887 | A | 11/1997 | Bagheri et al. | |
| 5,759,967 | A * | 6/1998 | Song et al. | 508/454 |
| 6,043,401 | A | 3/2000 | Bagheri et al. | |
| 6,107,257 | A | 8/2000 | Valcho et al. | |
| 6,133,209 | A | 10/2000 | Rath et al. | |
| 6,414,090 | B2 | 7/2002 | Minami et al. | |
| 6,414,091 | B2 | 7/2002 | Moritomi et al. | |
| 6,645,403 | B1 | 11/2003 | Park et al. | |
| 6,704,491 | B1 | 3/2004 | Revis | |
| 6,706,828 | B2 | 3/2004 | DiMaio | |
| 6,713,438 | B1 | 3/2004 | Baillargeon et al. | |
| 6,972,275 | B2 | 12/2005 | Forbus, Jr. | |
| 7,253,231 | B2 | 8/2007 | Devlin et al. | |
| 7,485,603 | B2 | 2/2009 | Bera et al. | |
| 7,786,057 | B2 | 8/2010 | Bera et al. | |
| 2003/0055184 | A1 | 3/2003 | Song et al. | |
| 2004/0002429 | A1 * | 1/2004 | Forbus, Jr. | 508/492 |
| 2006/0063685 | A1 * | 3/2006 | Purmer et al. | 508/273 |
| 2007/0037714 | A1 | 2/2007 | Olliges | |
| 2007/0189999 | A1 * | 8/2007 | Jones et al. | 424/63 |
| 2009/0036725 | A1 | 2/2009 | Wu et al. | |
| 2009/0156448 | A1 * | 6/2009 | Bera et al. | 508/368 |
| 2011/0269655 | A1 * | 11/2011 | Randles et al. | 508/455 |

FOREIGN PATENT DOCUMENTS

| | | |
|---|---|---|
| WO | 03020856 | 3/2003 |
| WO | 03091369 | 11/2003 |
| WO | 2007070691 | 6/2007 |
| WO | 2010063989 | 6/2010 |
| WO | WO 2010063989 A1 * | 6/2010 |

* cited by examiner

Figure 1. EHL Film Thickness of a 0.5 wt % Dispersion of PTE in PAO-8 in Comparison to Pure PAO-8 and Pure PTE
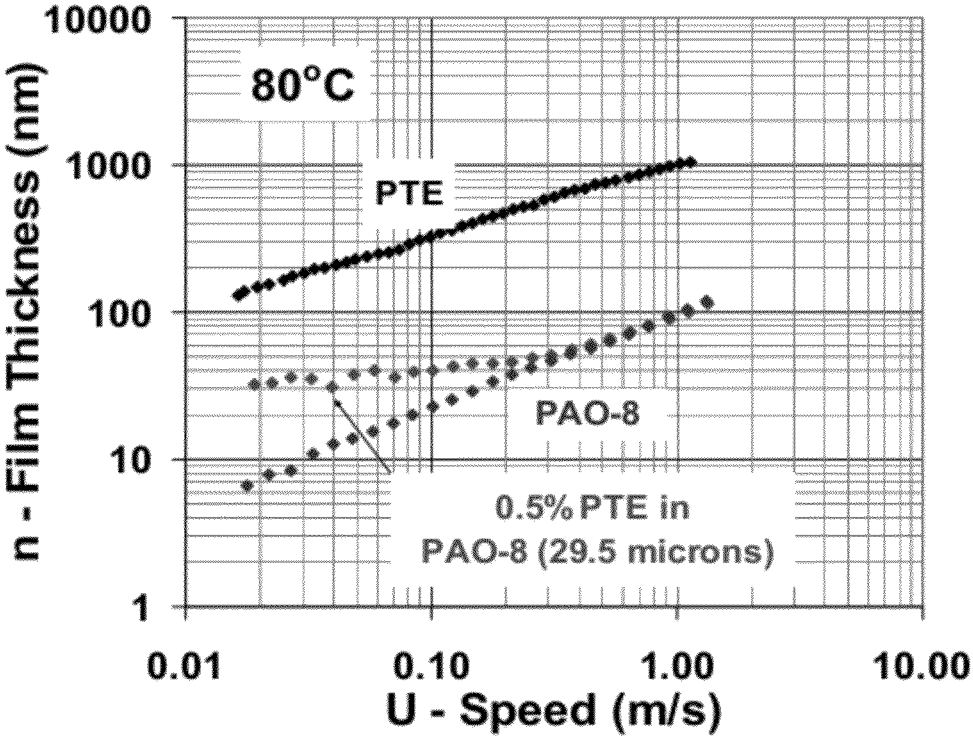

Figure 2. EHL Film Thickness of a 0.5 wt% Complex Ester Dispersion in PAO-8 in Comparison to Pure PAO-8 and Pure Complex Ester
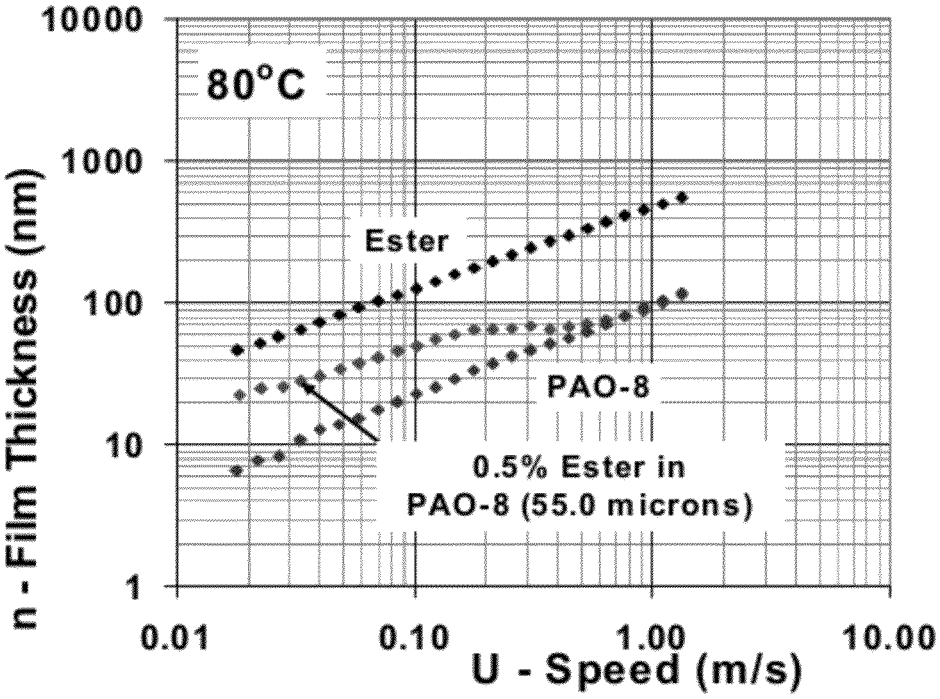

Figure 3. Influence of Preparation Process on Stability of Surfactant Stabilized Emulsions Droplet Size vs Time
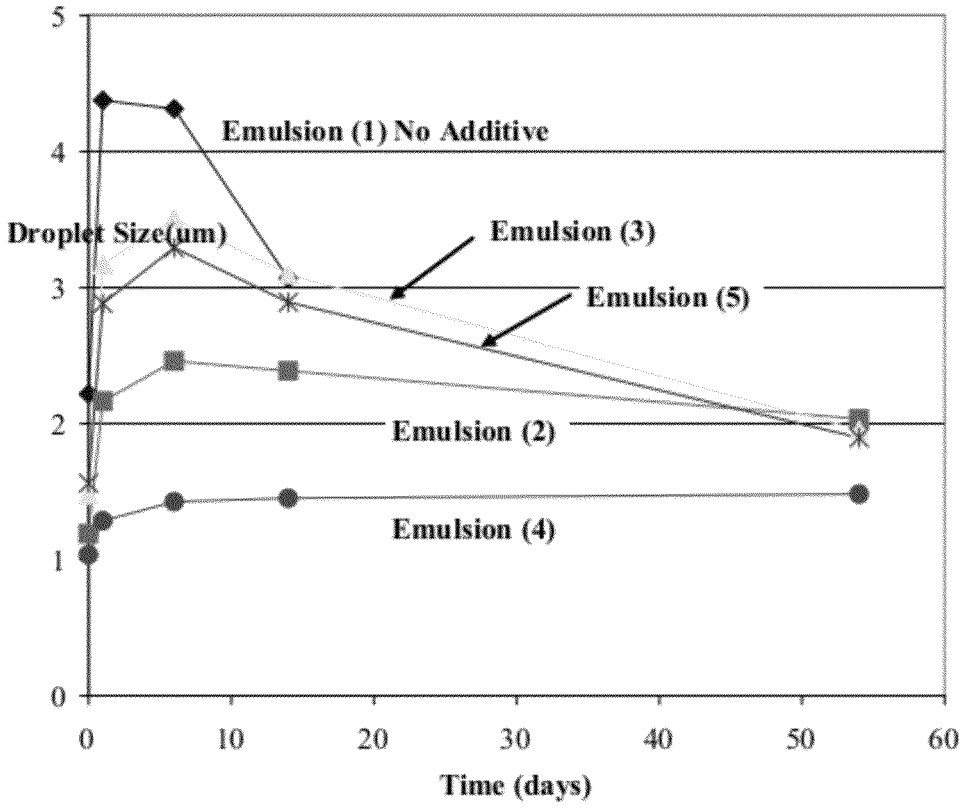

Figure 4. Stability of Surfactant Stabilized Emulsions - Transmittence vs Time
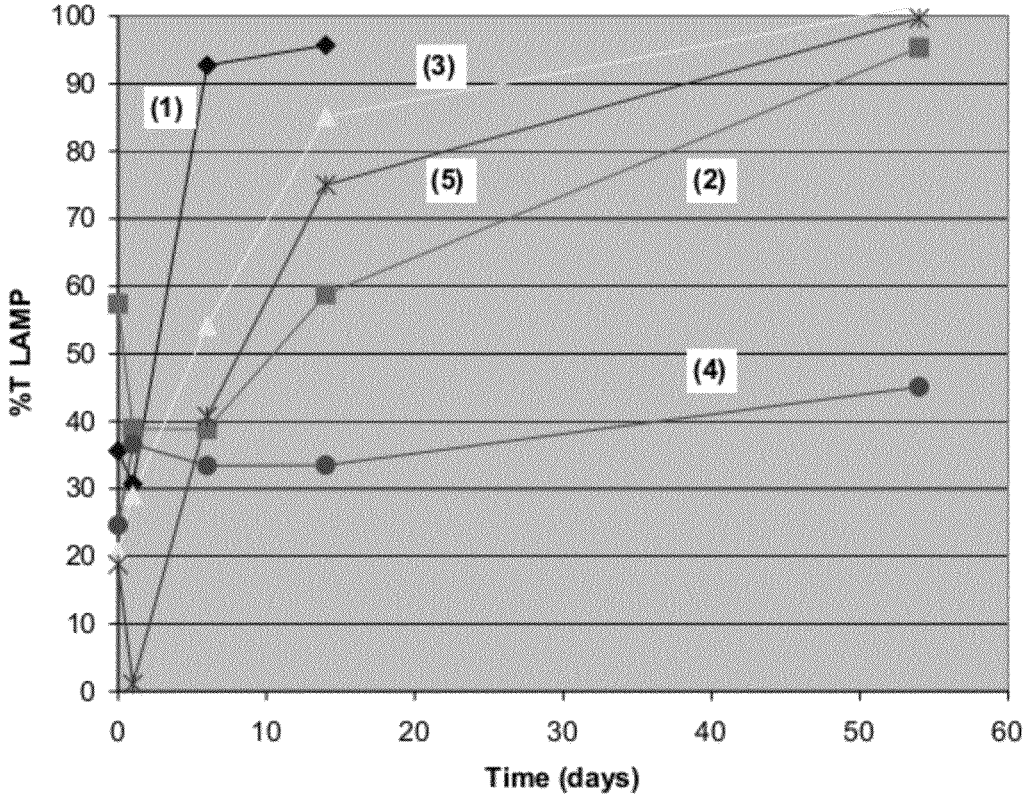

Figure 5. EHL Film Thickness of Microfluidized 0.5 wt% Complex Ester in PAO-8 with and without Stabilizing Agents (0.5 wt% PIBSA-PAM or 0.05 wt% Hitec 5777)
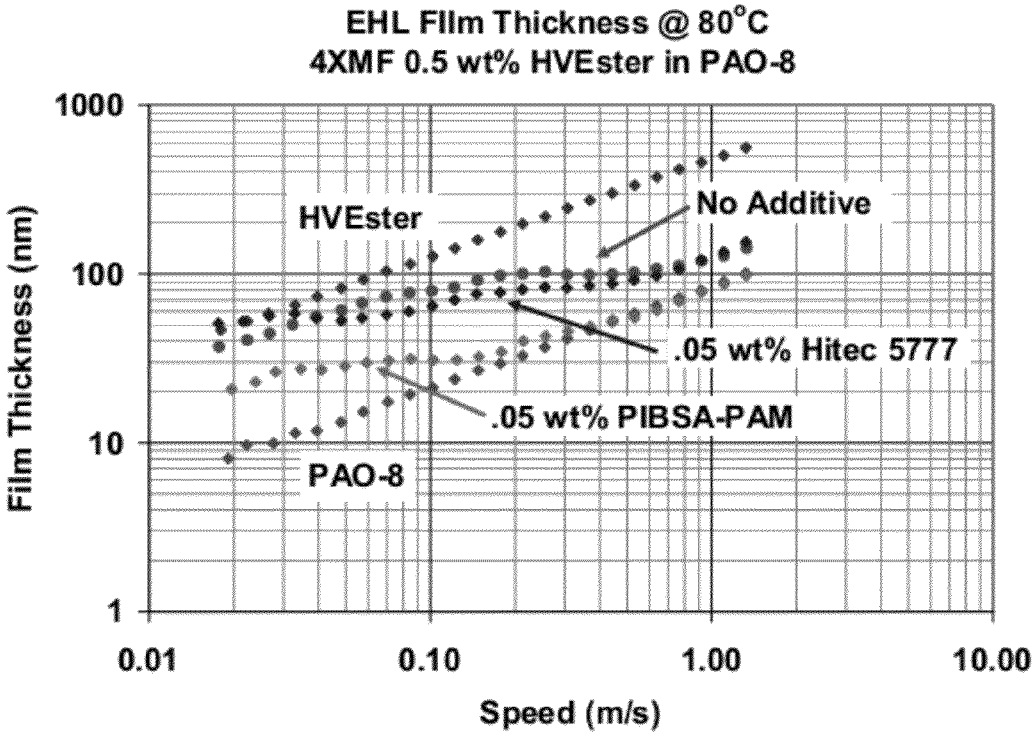

Figure 6. Synergistic Effect of Antiwear Additive on Stabilization of Complex Ester Emulsion with Hitec 5777 - Drop Size over Time
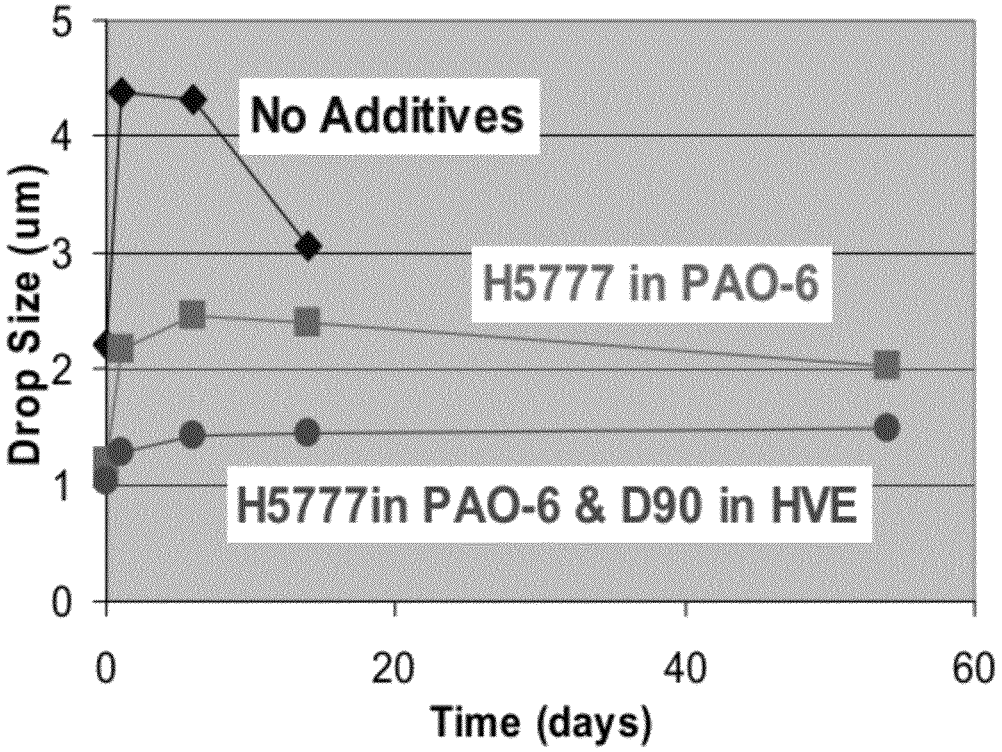

Figure 7. Synergistic Effect of Antiwear Additive on Stabilization of Complex Ester Emulsion with Hitec 5777 - Lamp Transmittence over Time
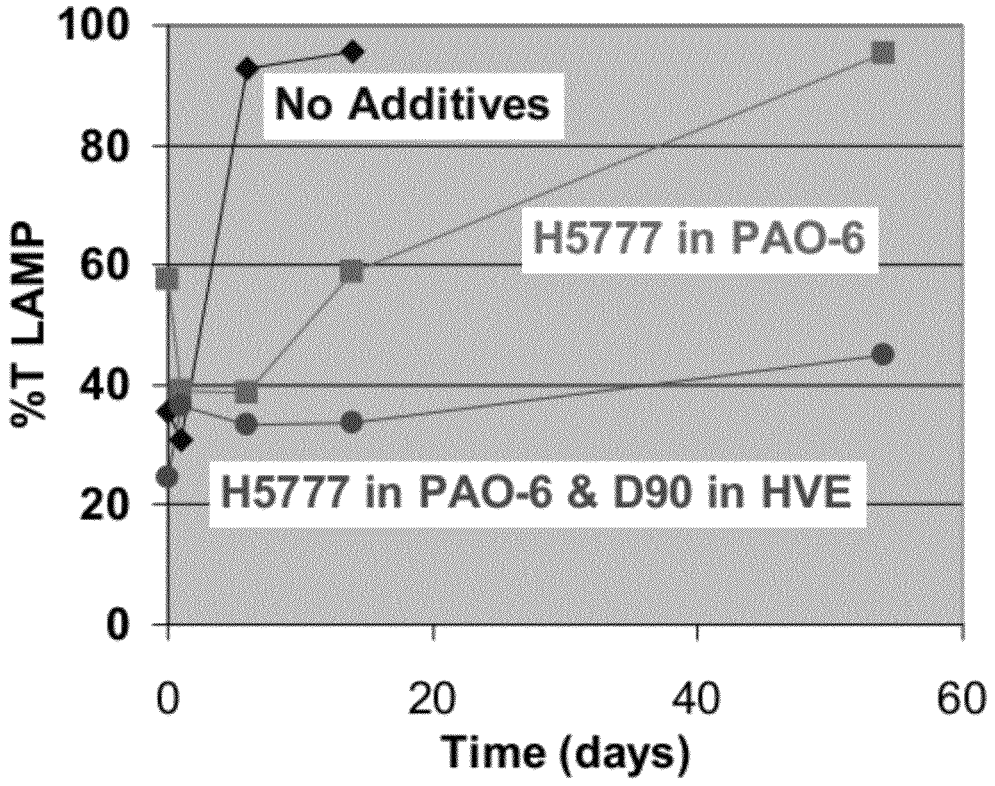

OIL-IN-OIL COMPOSITIONS AND METHODS OF MAKING

FIELD OF THE INVENTION

This invention is directed to a lubricant composition that is comprised of a continuous phase and a discontinuous phase. More specifically, this invention is directed to a two phase lubricant composition having a continuous phase of at least one Group II, III, IV or GTL base stock, optionally a low viscosity Group V base stock, and a discontinuous phase of at least one high viscosity ester having no ether linkages.

BACKGROUND OF THE INVENTION

A particular class of lubricant composition can be characterized as liquid lubricants having at least two distinct liquid phases. Often, these types of lubricants are considered as dispersions, although they are also referred to as emulsions. These types of lubricants are readily identified as having a relatively small quantity of the discontinuous phase, which is comprised of an oil type component and dispersed throughout the continuous oil base oil phase. Since an oil type composition is dispersed through another oil type composition, these lubricants are also referred to as oil-in-oil emulsions.

Oil-in-oil emulsions can provide substantial wear protection, yet be lower in viscosity relative to standard mineral oil type blended lubricants. Such lubricants can be useful in many applications and are desirable for their superior properties related to low viscosities, improved film thickness, and better lubricating performance.

U.S. Pat. No. 6,972,275, Forbus, discloses an oil-in-oil emulsion type of lubricant composition. The particular lubricant composition has a continuous phase of a carrier fluid comprised of polyalphaolefins and alkylated aromatics, and a discontinuous phase of a higher viscosity fluid. The carrier fluid and the high viscosity fluid are substantially immiscible and together form a relatively stable emulsion.

Two phase lubricants such as oil-in-oil emulsions have very good potential for numerous commercial applications. However, additional improvements in overall lubricant quality and performance are desired. Additional wear protection and lower drag are examples of qualities in which improvements are being sought.

SUMMARY OF THE INVENTION

This invention provides a lubricant composition that is comprised of a continuous phase and a discontinuous phase, i.e., a two phase lubricant composition, that has enhanced performance. In particular, the lubricant composition of this invention provides additional wear protection relative to comparable lubricants. It also provides lower drag performance characteristics relative to comparable lubricants.

According to one aspect of the invention, there is provided a lubricant composition. The composition is comprised of a continuous phase base oil and a discontinuous phase. The continuous phase base oil is comprised of a Group II, III, IV or GTL base stock or a blend of at least two of the Group II, III, IV or GTL base stocks, and the continuous phase base oil has, independently of the discontinuous phase, a viscosity of from 1 to 100 cSt at 100° C. The discontinuous phase is comprised of an ester composition having a mean average droplet size of from 0.01 microns to 20 microns, in which the ester composition is comprised of at least one ester compound having no ether linkages.

In an embodiment, the continuous phase is comprised of a Group IV base stock. The continuous phase can also be comprised of a blend of at least one of the Group II, III, IV or GTL base stocks and a Group V base stock.

In an alternative embodiment, the continuous phase base oil comprises a Group V base stock in an amount of not greater than 50 wt. %, based on total weight of the continuous phase base oil. Preferably, the continuous phase base oil comprises not greater than 5 wt % of a Group V base stock, base on total weight of the continuous phase base oil.

In another embodiment, the ester composition has, independently, a viscosity greater than 100 cSt at 100° C.

In an alternative embodiment, the lubricant composition is comprised of from 0.1 wt % to 10 wt % of the discontinuous phase. Preferably, the lubricant composition has a discontinuous phase has not greater than 10 wt. % ester having ether linkages, based on total independent weight of the discontinuous phase.

In an embodiment, the ester composition is comprised of adipate ester. Alternatively, the ester composition is comprised of complex ester.

The complex ester can be formed from a variety of components. Examples of such components include the reaction of three or more of the following compounds:

i. Monohydric aliphatic alcohols
ii. Monobasic aliphatic acids
iii. Aliphatic glycols or polyglycols
iv. Polyhydric aliphatic alcohols
v. Dibasic aliphatic acids, and
vi. Polybasic aliphatic acids where at least one polyfunctional alcohol and at least one polyfunctional acid are employed.

The lubricant composition optionally comprises one or more additive components. For example, the lubricant composition can comprise at least one nitrogen-containing olefin polymer dispersant or stabilizing agent. These types of components can be present in the lubricant composition in an amount of from 0.001 wt. % to 2 wt. %, based on total weight of the lubricating composition.

In one embodiment, the lubricant optionally includes at least one nitrogen-containing olefin polymer dispersant or stabilizing agent is a polyamine-derivatized poly α-olefin. Alternatively, the at least one nitrogen-containing olefin polymer dispersant or stabilizing agent is an olefin copolymer containing at least one dispersing group selected from the group consisting of alkyl amine, aryl amine, amide, a nitrogen-containing heterocyclic group and an ester group.

The lubricant can also include as an optional component at least antiwear agent in an amount of from 0.001 wt. % to 2 wt. %, based on total weight of the lubricating composition. For example, the antiwear agent can be an organic phosphate. A particular example of an the antiwear agent is triaryl phosphate.

The lubricant is typically low in sulfur. For example, the continuous phase base oil has, independently, a sulfur content of not greater than 0.05 wt %, based on total weight of the continuous phase base oil.

The lubricant has a desirable viscosity index. In particular, the continuous phase base oil component has a desirable viscosity index. For example, the continuous phase base oil has, independently, a viscosity index of at least 100.

According to another aspect of the invention, there is provided a method for reducing energy consumption in operating machinery. This method includes steps of adding to the machinery the lubricant composition of this invention in which composition is comprised of a continuous phase base oil and a discontinuous phase, and operating the machinery.

The continuous phase base oil is comprised of a Group II, III, IV or GTL base stock or a blend of at least two of the Group II, III, IV or GTL base stocks, and the continuous phase base oil has, independently of the discontinuous phase, a viscosity of from 1 to 100 cSt at 100° C. The discontinuous phase is comprised of an ester composition having a mean average droplet size of from 0.01 microns to 20 microns, in which the ester composition is comprised of at least one ester compound having no ether linkages.

BRIEF DESCRIPTION OF THE DRAWINGS

FIG. 1. EHL Film Thickness of a 0.5 wt % Dispersion of PTE in PAO-8 in Comparison to Pure PAO-8 and Pure PTE.

FIG. 2. EHL Film Thickness of a 0.5 wt % Complex Ester Dispersion in PAO-8 in Comparison to Pure PAO-8 and Pure Complex Ester.

FIG. 3. Influence of Preparation Process on Stability of Surfactant Stabilized Emulsions Droplet Size vs Time.

FIG. 4. Stability of Surfactant Stabilized Emulsions—Transmittence vs Time.

FIG. 5. EHL Film Thickness of Microfluidized 0.5 wt % Complex Ester in PAO-8 with and without Stabilizing Agents (0.5 wt % PIBSA-PAM or 0.05 wt % Hitec 5777).

FIG. 6. Synergistic Effect of Antiwear Additive on Stabilization of Complex Ester Emulsion with Hitec 5777—Drop Size over Time.

FIG. 7. Synergistic Effect of Antiwear Additive on Stabilization of Complex Ester Emulsion with Hitec 5777—Lamp Transmittence over Time.

DETAILED DESCRIPTION OF THE INVENTION

Introduction

This invention provides a lubricant composition that is comprised of a continuous phase and a discontinuous phase, i.e., a two phase lubricant composition. The continuous phase can also be referred to as a dispersion medium, and the discontinuous phase as a dispersed phase. The discontinuous or dispersed phase can be considered as particles or droplets, with the droplets being dispersed throughout the continuous phase.

The continuous phase and the discontinuous phase of the lubricant of this invention are oil or oil type compositions that are essentially insoluble in one another. The continuous phase can be any of a variety of relatively low viscosity oils, whereas the discontinuous phase is comprised of droplets of relatively high viscosity ester.

The lubricant composition is comprised of a continuous phase base oil that is comprised of a low viscosity Group II, III, IV or GTL base stock, or a blend of at least two the Group II, III, IV and GTL base stocks, optionally including a low viscosity Group V base stock, with the continuous phase base oil having, independently, a viscosity of from 1 to 100 cSt at 100° C. The lubricant composition is further comprised of a discontinuous phase that is comprised of an ester composition having a mean average droplet size of from 0.01 microns to 20 microns, in which the ester composition is comprised of at least one ester compound having no ether linkages.

The lubricant composition of this invention provides a high degree of wear protection for a variety of high pressure mechanical equipment. The lubricant is generally lower in viscosity relative to comparable single as well as dual phase lubricants. Due to the lower overall viscosity, machinery that is operated with the lubricant will experience less viscous drag. This means that the lubricant can provide a high degree of wear protection at lower energy consumption relative to comparable lubricants.

Continuous Phase Base Oil a. Group II, III, IV or GTL Base Stock

The lubricant composition of this invention comprises a continuous phase base oil of relatively low viscosity. The continuous phase base oil is comprised of a Group II, III, IV or Gas-to-Liquids (GTL) base stock or a blend of at least two of the Group II, III, IV or GTL base stocks. The terms "base oil" and "base stock" as referred to herein are to be considered consistent with the definitions as also stated in APPENDIX E—API BASE OIL INTERCHANGEABILITY GUIDELINES FOR PASSENGER CAR MOTOR OILS AND DIESEL ENGINE OILS, July 2009 Version. According to Appendix E, base oil is the base stock or blend of base stocks used in an API-licensed oil. Base stock is a lubricant component that is produced by a single manufacturer to the same specifications (independent of feed source or manufacturer's location); that meets the same manufacturer's specification; and that is identified by a unique formula, product identification number, or both.

The continuous phase base oil has, independently, a viscosity of from 1 cSt to 100 cSt at 100° C. The term independently means that the viscosity of the continuous phase base oil is determined after blending all of the individual base stocks together that comprise the continuous base oil phase, and prior to blending with the discontinuous phase base oil of relatively higher viscosity. Preferably, the continuous phase base oil has, independently, a viscosity of not greater than 80 cSt at 100° C., alternatively, not greater than 50 cSt at 100° C. or not greater than 30 cSt at 100° C. Exemplary ranges include from 1 cSt to 80 cSt at 100° C., from 2 cSt to 60 cSt at 100° C. and from 4 cSt to 50 cSt at 100° C.

In an embodiment, the continuous phase base oil has, independently, a sulfur content of not greater than 0.05 wt %, based on total weight of the continuous phase base oil. Preferably, the continuous phase base oil has, independently, a sulfur content of not greater than 0.03 wt %, more preferably not greater than 0.02 wt %, based on total weight of the continuous phase base oil.

In an embodiment, the continuous phase base oil has, independently, a viscosity index of at least 100. Preferably, the continuous phase base oil has, independently, a viscosity index of at least 120, more preferably at least 150.

Group II base stocks contain greater than or equal to 90 percent saturates. The Group II base stocks can contain less than or equal to 0.03 percent sulfur. They can also have a viscosity index greater than or equal to 80 and less than 120.

Group III base stocks contain greater than or equal to 90 percent saturates. The group III base stocks can contain less than or equal to 0.03 percent sulfur. They can also have a viscosity index greater than or equal to 120.

Group IV base stocks are polyalphaolefins (PAOs). PAOs can be obtained by polymerizing at least one monomer, e.g., 1-olefin, in the presence of hydrogen and a catalyst composition. Alpha-olefins suitable for use in the preparation of the PAOs can contain from 2 to about 30, preferably from 2 to 20, carbon atoms, and more preferably from about 6 to about 12 carbon atoms. Non-limiting examples of such alpha-olefins include ethylene, propylene, 2-methylpropene, 1-butene, 3-methyl-1-butene, 1-pentene, 4-methyl-1-pentene, 1-hexene, 1-heptene, 1-octene, 1-nonene, 1-decene, 1-undecene, 1-dodecene, 1-tridecene, 1-tetradecene, 1-pentadecene, 1-hexadecene, 1-heptadecene, 1-octadecene, 1-nonadecene, and 1-eicosene, including mixtures of at least two of the alpha-olefins. Preferred alpha-olefins for use herein are 1-octene, 1-decene and 1-dodecene, including mixtures thereof.

Specifically, the PAOs that can be used according to this invention can be produced by polymerization of olefin feed in the presence of a catalyst such as $AlCl_3$, $BF_3$, or promoted $AlCl_3$, $BF_3$. Processes for the production of such PAOs are disclosed, for example, in the following patents: U.S. Pat. Nos. 3,149,178; 3,382,291; 3,742,082; 3,769,363; 3,780,128; 4,172,855 and 4,956,122, which are fully incorporated by reference. Additional PAOs are also discussed in: Will, J. G. *Lubrication Fundamentals*, Marcel Dekker: New York, 1980. Subsequent to polymerization, the PAO lubricant range products are typically hydrogenated in order to reduce the residual unsaturation, generally to a level of greater than 90% of hydrogenation.

Low viscosity PAOs that can be used according to the invention can be produced by polymerization of an alpha-olefin in the presence of a polymerization catalyst such as Friedel-Crafts catalysts. These include, for example, boron trichloride, aluminum trichloride, or boron trifluoride, promoted with water, with alcohols such as ethanol, propanol, or butanol, with carboxylic acids, or with esters such as ethyl acetate or ethyl propionate or ether such as diethyl ether, diisopropyl ether, etc. (See for example, the methods disclosed by U.S. Pat. No. 4,149,178 or 3,382,291.) Other descriptions of PAO synthesis are found in the following patents: U.S. Pat. No. 3,742,082 (Brennan); U.S. Pat. No. 3,769,363 (Brennan); U.S. Pat. No. 3,876,720 (Heilman); U.S. Pat. No. 4,239,930 (Allphin); U.S. Pat. No. 4,367,352 (Watts); U.S. Pat. No. 4,413,156 (Watts); U.S. Pat. No. 4,434,408 (Larkin); U.S. Pat. No. 4,910,355 (Shubkin); U.S. Pat. No. 4,956,122 (Watts); and U.S. Pat. No. 5,068,487 (Theriot).

Another class of PAOs that can be incorporated as a part of this invention can be prepared by the action of a supported, reduced chromium catalyst with an alpha-olefin monomer. Such PAOs are described in U.S. Pat. No. 4,827,073 (Wu); U.S. Pat. No. 4,827,064 (Wu); U.S. Pat. No. 4,967,032 (Ho et al.); U.S. Pat. No. 4,926,004 (Pelrine et al.); and U.S. Pat. No. 4,914,254 (Pelrine). Commercially available PAOs include SpectraSyn™ 2, 4, 5, 6, 8, 10, 40 and 100. (ExxonMobil Chemical Company, Houston, Tex.).

PAOs made using metallocene catalyst systems can also be used according to this invention. Examples are described in U.S. Pat. No. 6,706,828 (equivalent to US 2004/0147693), where PAOs having KV100s of greater than 1,000 cSt are produced from meso-forms of certain metallocene catalysts under high hydrogen pressure with methyl alumoxane as a activator.

PAOs, such as polydecene, using various metallocene catalysts can also be incorporated into the lubricating composition of this invention. Examples of how such PAOs can be produced are described, for example, in WO 96/23751, EP 0 613 873, U.S. Pat. No. 5,688,887, U.S. Pat. No. 6,043,401, WO 03/020856 (equivalent to US 2003/0055184), U.S. Pat. No. 5,087,788, U.S. Pat. No. 6,414,090, U.S. Pat. No. 6,414,091, U.S. Pat. No. 4,704,491 U.S. Pat. No. 6,133,209, and U.S. Pat. No. 6,713,438.

In one embodiment of the invention, the polyolefin base oil component of this invention has a $M_w$ (weight average molecular weight) of about 200,000 or less, preferably from about 250 to 150,000, alternatively from about 280 to 100,000, or from about 300 to about 75,000 g/mol.

The polyolefin base oil component of this invention can have a molecular weight distribution (MWD) of greater than 1. MWD is defined as the ratio of weight-averaged MW to number-averaged MW ($M_w/M_n$), which is preferably determined by gel permeation chromatography (GPC) using polystyrene standards, as described in *Principles of Polymer Systems*, Fourth Edition, Ferdinand Rodrigues, Chapter 6, McGraw-Hill Book. An example of GPC solvent is HPLC Grade tetrahydrofuran, uninhibited, with the procedure being carried out at a column temperature of 30° C., a flow rate of 1 ml/min, and a sample concentration of 1 wt %, with a Column Set being a Phenogel 500 A, Linear, 10E6A. In one embodiment, the MWD is less than 5, preferably less than 4, preferably less than 3, preferably less than 2.5, preferably less than 2. Alternatively, polyolefin base oil component has a $M_w/M_n$ of from 1 to 3.5, alternatively from 1 to 2.5.

In one embodiment, the polyolefin base oil component has an unimodal $M_w/M_n$ determined by GPC. In another embodiment, the polyolefin base oil component has a multi-modal molecular weight distribution, where the MWD can be greater than 5. In another aspect, the polyolefin base oil component has a shoulder peak either before or after, or both before and after the major unimodal distribution. In this case, the MWD can be broad (>5) or narrow (<5 or <3 or <2), depending on the amount and size of the shoulder.

For many applications when superior shear stability, thermal stability or thermal/oxidative stability is preferred, it is preferable to have the polyolefins made with the narrowest possible MWD. PAO fluids with different viscosities, but made from the same feeds or catalysts, usually have different MWDs. In other words, MWDs of PAO fluids are dependent on fluid viscosity. Usually, lower viscosity fluids have narrower MWDs (smaller MWD value) and higher viscosity fluids have broader MWDs (larger MWD value). For a polyolefin base oil component with 100° C. KV of less than 100 cSt, or not greater than 80 cSt, or not greater than 50 cSt, or not greater than 30 cSt, the MWD of is preferably less than 2.5, alternatively less than 2.3.

$M_w$ and $M_n$ are also preferably measured by GPC method using a column for medium- to low-molecular weight polymers. Preferably the GPC method is carried out with tetrahydrofuran as solvent and polystyrene as calibration standard, as described above for MWD determination.

In a preferred embodiment of this invention, the polyolefin base oil component has a pour point of less than 25° C. (as measured by ASTM D 97), preferably less than 0° C., preferably less than −10° C., preferably less than −20° C., preferably less than −25° C., preferably less than −30° C., preferably less than −35° C., preferably less than −40° C., preferably less than −55° C., preferably from −10° C. to −80° C., preferably from −15° C. to −70° C.

Preferably, the polyolefin base oil component has a peak melting point ($T_m$) of 0° C. or less, and preferably have no measurable $T_m$. "No measurable $T_m$" is defined to be when there is no clear melting as observed by heat absorption in the DSC heating cycle measurement. Usually the amount of heat absorption is less than 20 J/g. It is preferred to have the heat release of less than 10 J/g, preferred less than 5 J/g, more preferred less than 1 J/g. Usually, it is preferred to have lower melting temperature, preferably below 0° C., more preferably below −10° C., more preferably below −20° C., more preferably below −30° C., more preferably below −40° C., most preferably no clear melting peak in DSC.

Peak melting point ($T_m$), crystallization temperature ($T_c$), heat of fusion and degree of crystallinity (also referred to as % crystallinity) can be determined using the following procedure. Differential scanning calorimetric (DSC) data is obtained using a TA Instruments model 2920 machine. Samples weighing approximately 7-10 mg are sealed in aluminum sample pans. The DSC data can be recorded by first cooling the sample to −100° C., and then gradually heating to 30° C. at a rate of 10° C./minute. The sample can be kept at 30° C. for 5 minutes before a second cooling-heating cycle is applied. Both the first and second cycle thermal events should be recorded. Areas under the curves are preferably measured and used to determine the heat of fusion and the degree of crystallinity. Additional details of such procedure is described in US Patent Pub. No. 2009/0036725.

In one embodiment of the invention, the polyolefin base oil component is preferred to have no appreciable cold crystallization in DSC measurement. During the heating cycle for the DSC method as described above, the PAO may crystallize if it has any crystallizable fraction. This cold crystallization can be observed on the DSC curve as a distinct region of heat release. The extent of the crystallization can be measured by the amount of heat release. Higher amount of heat release at lower temperature means higher degree of poor low temperature product. The cold crystallization is usually less desirable, as it may mean that the fluid may have very poor low temperature properties—not suitable for high performance application. It is preferred to have less than 20 j/g of heat release for this type of cold crystallization, preferred less than 10 j/g, less than 5 j/g and less than 1 j/g, most preferably to have no observable heat release due to cold crystallization during DSC heating cycle.

In another preferred embodiment, the polyolefin base oil component will have a viscosity index (VI) of greater than 60, preferably greater than 100, more preferably greater than 120, preferably at least 150. VI is determined according to ASTM Method D 2270-93 [1998]. VI of a fluid is usually dependent on the viscosity, feed composition and method of preparation. Higher viscosity fluid of the same feed composition usually has higher VI. The typical VI range for fluids made from $C_3$ or $C_4$ or $C_5$ linear alpha-olefin (LAO) will typically be from 65 to 250. Typical VI range for fluids made from $C_6$ or $C_7$ will be from 100 to 300, depending on fluid viscosity. Typical VI range for fluids made from $C_8$ to $C_{14}$ LAO, such as 1-octene, 1-nonene, 1-decene or 1-undecene or 1-dodecene, 1-tetradecene, are from 120 to >450, depending on viscosity. More specifically, the VI range for fluids made from 1-decene or 1-decene equivalent feeds are from about 100 to about 500, preferably from about 120 to about 400. Two or three or more alpha-olefins can be used as feeds, such as combination of $C_3+C_{10}$, $C_3+C_{14}$, $C_3+C_{16}$, $C_3+C_8$, $C_4+C_8$, $C_4+C_{18}$, $C_4+C_{16}$, $C_3+C_4+C_8$, $C_3+C_4+C_{12}$, $C_4+C_{10}+C_{12}$, $C_4+C_{10}+C_{14}$, $C_6+C_{12}$, $C_6+C_{12}+C_{14}$, $C_4+C_6+C_{10}+C_{14}$, $C_4+C_6+C_8+C_{10}+C_{12}+C_{14}+C_{16}+C_{18}$, etc. The product VI depends on the fluid viscosity and also on the choice of feed olefin composition. For the most demanding lubricant applications, it is better to use fluids with higher VI.

In another embodiment, it is preferable that the PAO base oil does not contain a significant amount of very light fraction. These light fractions contribute to high volatility, unstable viscosity, poor oxidative and thermal stability. They are usually removed in the final product. It is generally preferable to have less than 5 wt % of the polyolefin base oil with $C_{20}$ or lower carbon numbers, more preferably less than 10 wt % of the polyolefin base oil with $C_{24}$ or lower carbon numbers or more preferably less than 15 wt % of the polyolefin base oil with $C_{26}$ or lower carbon numbers. It is preferable to have less than 3 wt % of the polyolefin base oil with $C_{20}$ or lower carbon numbers, more preferably less than 5 wt % of the polyolefin base oil with $C_{24}$ or lower carbon numbers or more preferably less than 8 wt % of the polyolefin base oil with $C_{26}$ or lower carbon numbers. It is preferable to have less than 2 wt % of the polyolefin base oil with $C_{20}$ or lower carbon numbers, more preferably less than 3 wt % of the polyolefin base oil with $C_{24}$ or lower carbon numbers or more preferably less than 5 wt % of the polyolefin base oil with $C_{26}$ or lower carbon numbers. Also, the lower the amount of any of these light hydrocarbons, the better the fluid property of the polyolefin base oil as can be determined by Noack volatility testing (ASTM D5800).

In another embodiment, it is preferable that the PAO base oil does not contain a significant amount of a high molecular weight fraction. Such PAOs can be made by removing the high MW fraction or by using preferred metallocene catalysts (referred to as mPAO). Preferably, the PAO has not more than 5.0 wt % of polymer having a molecular weight of greater than 45,000 Daltons. Additionally or alternately, the amount of the PAO that has a molecular weight greater than 45,000 Daltons is not more than 1.5 wt %, or not more than 0.10 wt %. Additionally or alternately, the amount of the PAO that has a molecular weight greater than 60,000 Daltons is not more than 0.5 wt %, or not more than 0.20 wt %, or not more than 0.1 wt %. The mass fractions at molecular weights of 45,000 and 60,000 can be determined by GPC, as described above.

In general, Noack volatility is a strong function of fluid viscosity. Lower viscosity fluid usually has higher volatility and higher viscosity fluid has lower volatility. Preferably, the polyolefin base oil has a Noack volatility of less than 30 wt %, preferably less than 25 wt %, preferably less than 10 wt %, preferably less than 5 wt %, preferably less than 1 wt %, and preferably less than 0.5 wt %.

In another embodiment, the polyolefin base oil has a dielectric constant of 3 or less, usually 2.5 or less (1 kHz at 23° C., as determined by ASTM D 924).

In another embodiment, the polyolefin base oil can have a specific gravity of 0.6 to 0.9 g/cm$^3$, preferably 0.7 to 0.88 g/cm$^3$.

In another embodiment, the PAO's produced directly from the oligomerization or polymerization process are unsaturated olefins. The amount of unsaturation can be quantitatively measured by bromine number measurement according to the ASTM D 1159, or by proton or carbon-13 NMR. Proton NMR spectroscopic analysis can also differentiate and quantify the types of olefinic unsaturation: vinylidene, 1,2-disubstituted, trisubstituted, or vinyl. Carbon-13 NMR spectroscopy can confirm the olefin distribution calculated from the proton spectrum.

Both proton and carbon-13 NMR spectroscopy can quantify the extent of short chain branching (SCB) in the olefin oligomer, although carbon-13 NMR can provide greater specificity with respect to branch lengths. In the proton spectrum, the SCB branch methyl resonances fall in the 1.05-0.7 ppm range. SCBs of sufficiently different length will give methyl peaks that are distinct enough to be integrated separately or deconvoluted to provide a branch length distribution. The remaining methylene and methine signals resonate in the 3.0-1.05 ppm range. In order to relate the integrals to CH, $CH_2$, and $CH_3$ concentrations, each integral must be corrected for the proton multiplicity. The methyl integral is divided by three to derive the number of methyl groups; the remaining aliphatic integral is assumed to comprise one CH signal for each methyl group, with the remaining integral as $CH_2$ signal. The ratio of $CH_3/(CH+CH_2+CH_3)$ gives the methyl group concentration.

Similar logic applies to the carbon-13 NMR analysis, with the exception that no proton multiplicity corrections need be made. Furthermore, the enhanced spectral/structural resolution of $^{13}C$ NMR vis a vis $^{1}H$ NMR allows differentiation of ions according to branch lengths. Typically, the methyl resonances can be integrated separately to give branch concentrations for methyls (20.5-15 ppm), propyls (15-14.3 ppm), butyl-and-longer branches (14.3-13.9 ppm), and ethyls (13.9-7 ppm).

Olefin analysis is readily performed by proton NMR, with the olefinic signal between 5.9 and 4.7 ppm subdivided according to the alkyl substitution pattern of the olefin. Vinyl group CH protons resonate between 5.9-5.7 ppm, and the vinyl $CH_2$ protons between 5.3 and 4.85 ppm. 1,2-disubstituted olefinic protons resonate in the 5.5-5.3 ppm range. The trisubstituted olefin peaks overlap the vinyl $CH_2$ peaks in the 5.3-4.85 ppm region; the vinyl contributions to this region are removed by subtraction based on twice the vinyl CH integral. The 1,1-disubstituted- or vinylidene-olefins resonate in the 4.85-4.6 ppm region. The olefinic resonances, once corrected for the proton multiplicities can be normalized to give a mole-percentage olefin distribution, or compared to the multiplicity-corrected aliphatic region (as was described above for the methyl analysis) to give fractional concentrations (e.g. olefins per 100 carbons).

Generally, the amount of unsaturation strongly depends on fluid viscosity or fluid molecular weight. Lower viscosity fluid has higher degree of unsaturation and higher bromine number. Higher viscosity fluid has lower degree of unsaturation and lower bromine number. If a large amount of hydrogen or high hydrogen pressure is applied during the polymerization step, the bromine number can be lower than without the hydrogen presence. Typically, for PAO produced from 1-decene or other suitable LAOS, the as-synthesized PAO will have bromine number of from 80 to less than 1, but greater than 0, preferably from about 40 to about 0.01, preferably from about 20 to about 0.5, depending on fluid viscosity.

GTL base stocks include base stocks derived from one or many possible types of GTL processes. The GTL process generally refers to a chemical conversion of natural gas, mostly methane, into synthesis gas (mainly CO and hydrogen). Alternatively, solid coal can also be converted into synthesis gas of mainly CO and hydrogen. The synthesis gas is then converted into mostly linear paraffins by Fishcher-Tropsch process. The linear paraffins have wide molecular size distributions. The high molecular weight linear paraffinic fraction of $C_{25}$ and higher can be isolated by distillation or fractionation and then subjected to hydro-isomerization by different catalysts into lubricant base stocks. This GTL base stock has kinematic viscosity @100° C. (KV100) of 3 to 20 or 30 cSt in certain embodiments. The GTL base stocks and/or base oil may be used as such or in combination with other hydrodewaxed or hydroisomerized, catalytic or solvent dewaxed lube base stock.

In one embodiment, the GTL useful in the lubricants described herein have a VI of at least 100, and at least 120 in another embodiment. In certain embodiments, the GTL base stock has a pour point within the range of from 20 or 10° C. to −15 or −20° C. Generally, any lube base stock derived from the GTL process can be used in the blends described herein, provided that it meets the appropriate low viscosity requirements of the continuous phase base oil.

One example of a GTL base stock is one comprising paraffinic hydrocarbon components in which the extent of branching, as measured by the percentage of methyl hydrogens ("branching index" or "BI"), and the proximity of branching, as measured by the percentage of recurring methylene carbons which are four or more carbons removed from an end group or branch ($CH_2 \geq 4$), are such that: (a) $BI-0.5\ (CH_2 \geq 4) > 15$ and (b) $BI+0.85\ (CH_2 \geq 4) < 45$ as measured over said liquid hydrocarbon composition as a whole.

Another example of a GTL base stock is also characterized as comprising a mixture of branched paraffins, characterized in that the lubricant base oil contains at least 90% of a mixture of branched paraffins, wherein said branched paraffins are paraffins having a carbon chain length of $C_{20}$ to $C_{40}$, a molecular weight of 280 to 562, a boiling range of 343° C. to 566° C., and wherein said branched paraffins contain up to four alkyl branches and wherein the free carbon index of said branched paraffins is at least 3. The GTL base stocks, and the method for measuring the branching index, are described in more detail in, for example, WO 2007/070691.

b. Optional Group V Base Stock

The lubricating composition can optionally comprise a low viscosity API Group V base oil component in the continuous phase base oil. The Group V base oil component is considered to be a composition comprised of a Group V base stock or a blend of more than one Group V base stock component. Group V base stocks include all other base stocks not included in Group I, II, III, or IV, as set forth in API APPENDIX E.

In one embodiment, the continuous phase base oil comprises not greater than 50 wt % of the Group V base oil component, based on total weight of the continuous phase base oil. Alternatively, the continuous phase base oil comprises not greater than 20 wt %, or not greater than 10 wt %, or not greater than 5 wt % of the Group V base oil component, based on total weight of the continuous phase base oil.

In one embodiment, the Group V base oil component is present and is comprised of at least one Group V base stock selected from the group consisting of alkylated aromatics, low viscosity esters, polyalkylene glycols and carboxylic acids such as multi-basic carboxylic acids.

Examples of alkylated aromatics include, but are not limited to alkylnapthalenes and alkylbenzenes. The alkylnaphthalenes can include a single alkyl chain (monalkylnaphthalene), two alkyl chains (dialkylnaphthalene), or multiple alkyl chains (polyalkylnaphthalene). The alkylbenzenes can include a single alkyl chain (monalkylbenzene), two alkyl chains (dialkylbenzne), or multiple alkyl chains (polyalkylbenzene). Each alkyl group present can be independently represented by a $C_1$-$C_{30}$ alkyl group, which can be linear or branched.

Examples of low viscosity esters include, but are not limited to polyol esters (reaction products of at least one carboxylic acid, i.e., mono-basic or multi-basic carboxylic acid, and at least one polyol) and can include low viscosity complex alcohol esters (reaction products of at least one polyol, multi-basic carboxylic acid and mono-alcohol). Specific examples of polyol esters include, but are not limited to, di-iso tridecyl adipate, diiosoctyl ester and trimethylolpropane esters of $C_8$-$C_{10}$ acids. A specific example of a carboxylic acid includes, but is not limited to, hexanedioic acid.

Additional examples of low viscosity esters include esters of monocarboxylic or dicarboxylic acids or their anhydrides (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with any one or more of a variety of mono-alcohols (e.g., butyl alcohol, hexyl alcohol, dodecyl alcohol, 2-ethylhexyl alcohol, ethylene glycol, diethylene glycol monoether, propylene glycol). These esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate and dieicosyl sebacate. Other examples of esters include those made from $C_5$ to $C_{12}$ monocarboxylic acids and polyols such as neopentyl glycol, pentaerythritol, dipentaerythritol and tripentaerythritol.

The Group V base oil can be relatively high in polarity. In general, polarity can be quantified by aniline point, such as according to ASTM D611-07 Standard Test Methods for Aniline Point and Mixed Aniline Point of Petroleum Products and Hydrocarbon Solvents. Lower aniline point indicates higher polarity, and higher aniline point indicates lower polarity. In one embodiment of the invention, the Group V base oil component of the lubricating composition of the invention has an aniline point of at least −5° C., alternatively an aniline point of at least 0° C., or at least 10° C., or at least 20° C., or at least 40° C. or at least 60° C.

c. Group I Base Stock

The continuous phase base oil can comprise, independently, a limited amount of Group I base stock. Group I base stocks contain less than 90 percent saturates, tested according to ASTM D2007. The Group I base stocks can contain greater than 0.03 percent sulfur, tested according to ASTM D1552, D2622, D3120, D4294, of D4927. They can also have a viscosity index of greater than or equal to 80 and less than 120, tested according to ASTM D2270. The amount of Group I base stock is limited so as not to adversely affect the sulfur content or the viscosity index of the continuous phase base oil.

In an embodiment, the continuous phase base oil can comprise, independently, not greater than 5 wt % Group I base stock, based on total weight of the continuous phase base oil. Preferably, the continuous phase base oil comprised not greater than 3 wt %, more preferably not greater than 1 wt %, Group I base stock, based on total weight of the continuous phase.

Discontinuous Phase a. High Viscosity Ester Composition

The discontinuous phase is represented by droplets dispersed throughout the continuous phase. The droplets are relatively evenly dispersed throughout the continuous phase and remain so for very long periods of time. The droplets are of a size to resist rapid coalescence, this providing for a stable dispersion of droplets. The mean number average droplet size (as determined by laser light scattering) is not greater than 20 microns, typically from 0.01 micron to 20 microns. The droplets can also be dispersed throughout the continuous phase at a mean number average droplet size of not greater than 10 microns or 5 microns.

The discontinuous phase is comprised of an ester composition that includes the reaction product of at least one carboxylic acid or anhydride and at least one alcohol, and is independently higher in viscosity than the continuous phase base oil. Preferably, the discontinuous phase has, independently, a viscosity of greater than 100 cSt at 100° C. As with the continuous phase base oil, independently means that the viscosity of the discontinuous phase is determined after blending all of the individual base stocks together that comprise the discontinuous phase, and prior to blending with the continuous phase base oil of relatively lower viscosity. Preferably, the discontinuous phase base oil has, independently, a viscosity of at least 120 cSt at 100° C., or at least 140 cSt at 100° C. or at least 160 cSt at 100° C. Exemplary ranges include from greater than 100 cSt to 6,000 cSt at 100° C., from 120 cSt to 4,000 cSt at 100° C. and from 140 cSt to 3,000 cSt at 100° C.

In one embodiment, the ester composition is comprised of a complex ester. A complex ester is considered a reaction product of a polyol, a polybasic acid or anhydride, and a mono-alcohol.

In a particular embodiment, the complex ester is a reaction product of:

a. a polyhydroxyl compound represented by the general formula:

$$R(OH)_n$$

wherein R is an aliphatic or cyclo-aliphatic hydrocarbyl group and n is at least 2, with the hydrocarbyl group preferably containing from about 2 to 20 carbon atoms;

b. a polybasic acid or an anhydride of a polybasic acid, preferably with a ratio of equivalents of the polybasic acid to equivalents of alcohol of the polyhydroxyl compound in the range of from about 1.6:1 to 2:1; and c. a monohydric alcohol, preferably at a ratio of equivalents of the monohydric alcohol to equivalents of the polybasic acid in the range of from about 0.8:1 to 1.2:1.

Among the polyols (i.e., polyhydroxyl compounds) which can be reacted to produce the complex ester are those represented by the general formula:

$$R(OH)_n$$

wherein R is an aliphatic or cyclo-aliphatic hydrocarbyl group (preferably an alkyl) and n is at least 2. The hydrocarbyl group can contain from about 2 to about 20 or more carbon atoms, and the hydrocarbyl group can also contain substituents such as chlorine, nitrogen and/or oxygen atoms.

The polyhydroxyl compounds preferably include no oxyalkylene groups and, thus, the polyhydroxyl compounds exclude compounds such as polyetherpolyols. The number of carbon atoms (i.e., carbon number, wherein the term carbon number as used throughout this application refers to the total number of carbon atoms in either the acid or alcohol as the case may be) and number of hydroxy groups (i.e., hydroxyl number) contained in the polyhydroxyl compound used to form the carboxylic esters may vary over a wide range.

The following alcohols are particularly useful as polyols: neopentyl glycol, trimethylolethane, trimethylolpropane, trimethylolbutane, mono-pentaerythritol, technical grade pentaerythritol, and di-pentaerythritol. Particularly preferred alcohols are technical grade (e.g., approximately 88% mono-, 10% di- and 1-2% tri-pentaerythritol) pentaerythritol, mono-pentaerythritol, di-pentaerythritol, and trimethylolpropane.

Polybasic or polycarboxylic acids that can be used to produce the complex ester include one or more of $C_2$ to $C_{16}$ diacids. Examples include, but are not limited to adipic, azelaic, sebacic and dodecanedioic acids.

Anhydrides of polybasic acids can be used in place of the polybasic acids to produce the complex esters. Examples include, but are not limited to, succinic anhydride, glutaric anhydride, adipic anhydride, maleic anhydride, phthalic anhydride, nadic anhydride, methyl nadic anhydride, hexahydrophthalic anhydride, and mixed anhydrides of polybasic acids.

Among the alcohols which can be reacted with the diacid and polyol are, by way of example, any one or more of $C_5$ to $C_{13}$ branched and/or linear monohydric alcohol (mono-alcohol) selected from the group consisting of isopentyl alcohol, n-pentyl alcohol, isohexyl alcohol, n-hexyl alcohol, isoheptyl alcohol, n-heptyl alcohol, iso-octyl alcohol (e.g., 2-ethyl hexanol or iso-octyl alcohol), n-octyl alcohol, iso-nonyl alcohol, n-nonyl alcohol, isodecyl alcohol, and n-decyl alcohol. Preferably, at least one linear monohydric alcohol is present at up to 20 mole %, based on the total amount of monohydric alcohol.

An example of a particular class of monohydric alcohol that can be used to produce the complex ester is oxo alcohol. Oxo alcohols are manufactured by a process in which propylene and other olefins are oligomerized over a catalyst (e.g., a phosphoric acid on Kieselguhr clay) and then distilled to achieve various unsaturated (olefinic) streams largely comprising a single carbon number. These streams can then be reacted under hydroformylation conditions using a cobalt carbonyl catalyst with synthesis gas (carbon monoxide and hydrogen) so as to produce a multi-isomer mix of aldehydes/alcohols. The mix of aldehydes/alcohols can then be introduced to a hydrogenation reactor and hydrogenated to a mixture of branched alcohols comprising mostly alcohols of one carbon greater than the number of carbons in the feed olefin stream.

Examples of branched oxo alcohols include monohydric oxo alcohols which have a carbon number in the range of from about $C_5$ to $C_{13}$. A particular oxo alcohol includes iso-octyl alcohol formed from the cobalt oxo process and 2-ethylhexanol which is formed from the rhodium oxo process.

The term "iso" is meant to convey a multiple isomer product made by the oxo process. It is desirable to have a branched oxo alcohol comprising multiple isomers, preferably more than 3 isomers, most preferably more than 5 isomers.

Branched oxo alcohols can be produced in the so-called "oxo" process by hydroformylation of branched $C_4$ to $C_{12}$ olefin fractions to a corresponding branched $C_5$ to $C_{13}$ alcohol/aldehyde-containing oxonation product. In the process for forming oxo alcohols it is desirable to form an alcohol/aldehyde intermediate from the oxonation product followed by conversion of the crude oxo alcohol/aldehyde product to an all oxo alcohol product.

The production of branched oxo alcohols from the cobalt catalyzed hydroformylation of an olefinic feedstream preferably comprises the following steps:

i. hydroformylating an olefinic feedstream by reaction with carbon monoxide and hydrogen (i.e., synthesis gas) in the presence of a hydroformylation catalyst under reaction conditions that promote the formation of an alcohol/aldehyde-rich crude reaction product;

ii. demetalling the alcohol/aldehyde-rich crude reaction product to recover therefrom the hydroformylation catalyst and a substantially catalyst-free, alcohol/aldehyde-rich crude reaction product; and iii. hydrogenating the alcohol/aldehyde-rich crude reaction product in the presence of a hydrogenation catalyst (e.g., massive nickel catalyst) to produce an alcohol-rich reaction product.

The olefinic feedstream is comprised of at least one $C_4$ to $C_{12}$ olefin, more preferably at least one branched $C_7$ to $C_9$ olefin. Moreover, the olefinic feedstream is preferably a branched olefin, although a linear olefin which is capable of producing all branched oxo alcohols can also be used. The hydroformylation and subsequent hydrogenation in the presence of an alcohol-forming catalyst, is capable of producing branched $C_5$ to $C_{13}$ alcohols, more preferably branched $C_8$ alcohol, branched $C_9$ alcohol, and isodecyl alcohol. Each of the branched oxo $C_5$ to $C_{13}$ alcohols formed by the oxo process typically comprises, for example, a mixture of branched oxo alcohol isomers alcohol comprises a mixture of 3,5-dimethyl hexanol, 4,5-dimethyl hexanol, 3,4-dimethyl hexanol, 5-methyl heptanol, 4-methyl heptanol and a mixture of other methyl heptanols and dimethyl hexanols. Any type of catalyst capable of converting oxo aldehydes to oxo alcohols can be used to produce the complex ester.

In an alternative embodiment, complex esters used as the high viscosity ester of this invention refers to esters formed from the reaction of three or more of the following compounds:

i. Monohydric aliphatic alcohols
ii. Monobasic aliphatic acids
iii. Aliphatic glycols or polyglycols
iv. Polyhydric aliphatic alcohols
v. Dibasic aliphatic acids
vi. Polybasic aliphatic acids where at least one polyfunctional alcohol and at least one polyfunctional acid are employed.

Examples of the above complex esters include:

Glycol centered complex esters; i.e., esters having a chain exemplified as monohydric alcohol-dibasic acid-(glycol-dibasic acid) x-monohydric alcohol, wherein x is a number greater than 0, preferably about 1 to about 6;

Dibasic acid centered complex esters; i.e., esters having a chain structure which may be exemplified as monobasic acid-glycol-(dibasic acid-glycol) x-monobasic acid, wherein x is a number greater than 0, preferably about 1 to about 6;

Alcohol acid terminated complex esters; i.e., esters having a chain structure which may be exemplified as monobasic acid-(glycol-dibasic acid) x-monohydric alcohol, wherein x is a number greater than 0, preferably about 1 to about 6; and Dibasic acid centered complex esters; i.e. esters having a chain structure which may be exemplified as mono-basic acid-polyol-(dibasic acid)-polyol-monobasic acid.

Preparation of complex esters is disclosed in U.S. Pat. Nos. 2,575,195, 2,575,196, and 3,016,353 and 4,440,657. Generally, the monohydric aliphatic alcohols used in the preparation of these esters will have from about 1 to about 18, and preferably about 4 to about 13 carbon atoms in the molecule and the same may have a straight or branched chain structure. The polyhydric aliphatic alcohols which may be used to prepare esters of this type generally will have from about 4 to about 25 and preferably about 5 to about 20 carbon atoms per molecule and the same may contain ether linkages. The aliphatic glycols or polyglycols may contain from about 2 to about 70 and preferably from about 2 to about 18 carbon atoms per molecule and also may contain ether linkages. Monobasic aliphatic acids which may be used to prepare these esters will generally contain from about 2 to about 22, and preferably from about 4 to about 12 carbon atoms and these materials may have either straight or branched chain structures. The dibasic acids which may be used in the preparation of the complex esters will have from about 2 to about 25, and preferably about 4 to about 14 carbon atoms in the molecule. The polybasic aliphatic acids will contain from about 3 to about 30, and preferably about 4 to about 14 carbon atoms in the molecule.

An example of a preferred ester is represented by the formula:

$$[R_1—C(=O)—O—CH_2]_3C—CH_2—\{O—C(=O)—R_3—C(=O)—O—CH_2—C[CH_2—O—C(=O)—R]_2CH_2\}_n—O—C(=O)—R_2$$

wherein $R_1$ and $R_2$ are independently from 2 to 22 carbons, which can be straight chained or branched, and can further include aliphatic or aromatic rings, R3 is from 2 to 25 carbons, and can be straight chained or branched, and can further include aliphatic or aromatic rings, and n is an integer from 1 to 9.

The dispersed phase is present in the lubricant in an amount sufficient to promote improved lubrication performance relative to the continuous phase base oil alone. The dispersed phase will also be present in the lubricant in an amount sufficient to promote the formation of a two-phase lubricant. As such, an amount of the dispersed phase can be present such that it surpasses the critical miscibility concentration in the continuous phase base oil. Generally, the dispersed phase will be present in the continuous phase base oil in relatively small amounts. Typically, the discontinuous phase will be present in the lubricant in an amount of from about 0.1% to about 10% by weight, or more preferably from about 0.1% to about 5% by weight, or even more preferably from about 0.1% to about 3% by weight, base on total weight of the lubricant.

The discontinuous phase can include some amount of ester having ether linkages in the ester composition. However, the amount of ester having ether linkages should be kept to a minimum. Preferably, the ester composition that comprises the discontinuous phase has not greater than 10 wt. % ester having ether linkages, more preferably not greater than 5 wt. %, and most preferably not greater than 1 wt %, based on total independent weight of the discontinuous phase.

Dispersants that Act as Stabilizing Agents

The lubricating composition of this invention can also optionally contain dispersants that act as stabilizing agents for the discontinuous phase. These dispersants or agents can be added during the manufacturing process at relatively low levels, with the addition providing additional stability to the discontinuous phase. Particularly preferred dispersants or agents are nitrogen-containing dispersants such as nitrogen-containing olefin polymers.

Examples of nitrogen-containing olefin polymer dispersants or stabilizing agents useful according to the invention include polyamine-derivatized poly α-olefins, particularly ethylene/butene alpha-olefin and polyisobutylene-based dispersants. Particularly preferred are ashless dispersants derived from polyisobutylene substituted with succinic anhydride groups and reacted with polyethylene amines, e.g., polyethylene diamine, tetraethylene pentamine; or a polyoxyalkylene polyamine, e.g., polyoxypropylene diamine, trimethylolaminomethane; a hydroxy compound, e.g., pentaerythritol; and combinations thereof. One particularl dispersant combination is a combination of (A) polyisobutylene substituted with succinic anhydride groups and reacted with (B) a hydroxy compound, e.g., pentaerythritol; (C) a polyoxyalkylene polyamine, e.g., polyoxypropylene diamine, or (D) a polyalkylene diamine, e.g., polyethylene diamine and tetraethylene pentamine using about 0.3 to about 2 moles of (B), (C) and/or (D) per mole of (A). Another dispersant combination comprises a combination of (A) polyisobutenyl succinic anhydride with (B) a polyalkylene polyamine, e.g., tetraethylene pentamine, and (C) a polyhydric alcohol or polyhydroxy-substituted aliphatic primary amine, e.g., pentaerythritol or trismethylolaminomethane.

Additional examples of nitrogen-containing olefin polymer dispersants or stabilizing agents useful according to the invention include olefin copolymers (OCP) containing at least one dispersing group selected from the group consisting of alkyl amine, aryl amine, amide, a nitrogen-containing heterocyclic group and an ester group. The olefin copolymers can comprise any combination of olefin monomers. An example includes ethylene and at least one other α-olefin. The at least one other α-olefin monomer is selected from an α-olefin having 3 to 18 carbon atoms, and is most preferably propylene. Copolymers of ethylene and higher α-olefins, such as propylene, can include other polymerizable monomers. Examples of these other monomers are non-conjugated dienes such as the following, non-limiting examples:

a. straight chain dienes such as 1,4-hexadiene and 1,6-octadiene;
b. branched chain acyclic dienes such as 5-methyl-1,4-hexadiene; 3,7-dimethyl-1,6-octadiene; 3,7-dimethyl-1,7-octadiene and mixed isomers of dihydro-mycene and dihydroocinene;
c. single ring alicyclic dienes such as 1,4-cyclohexadiene; 1,5-cyclooctadiene; and 1,5-cyclododecadiene; and
d. multi-ring alicyclic fused and bridged ring dienes such as tetrahydroindene; methyltetrahydroindene; dicyclopentadiene; bicyclo-(2,2,1)-hepta-2,5-diene; alkenyl, alkylidene, cycloalkenyl and cycloalkylidene norbornenes such as 5-methylene-2-norbornene (MNB), 5-ethylidene-2-norbornene (ENB), 5-propylene-2-norbornene, 5-isoproylidene-2-norbornene, 5-(4-cyclopentyenyl)-2-norbornene; 5-cyclohexylidene-2-norbornene.

Of the non-conjugated dienes that can be used, dienes containing at least one of the double bonds in a strained ring are preferred. One preferred diene is 5-ethylidene-2-norbornene (ENB). The amount of diene (wt. basis) in the copolymer can be from 0.1% to about 20%, with 0.1% to about 15% being preferred, and 0.1% to about 10% being most preferred. As already noted, the most preferred olefin copolymer is ethylene-propylene. The average ethylene content of the copolymer can be as low as 20% on a weight basis. The preferred minimum ethylene content is about 25%. A more preferred minimum is 30%. The maximum ethylene content can be as high as 90% on a weight basis, preferably the maximum ethylene content is 85%, most preferably about 80%. Preferably, the olefin copolymers contain from about 35 to 75 wt. % ethylene, more preferably from about 50 to about 70 wt. % ethylene.

The molecular weight (number average) of the olefin copolymer can be as low as 2000, but the preferred minimum is 10,000. The more preferred minimum is 15,000, with the most preferred minimum number average molecular weight being 20,000. The maximum number average molecular weight can be as high as 12,000,000. A preferred maximum is about 1,000,000, with the most preferred maximum being about 750,000. A particular range of number average molecular weight for the olefin copolymers is from about 50,000 to about 500,000.

Olefin copolymers can be rendered multifunctional by attaching a nitrogen-containing polar moiety (e.g., amine, amine-alcohol or amide) to the polymer backbone. As an example, the nitrogen-containing moieties can be of the formula R—N—R'R", wherein R, R' and R" are independently alkyl, aryl, an aromatic amine or H. One method for forming a multifunctional OCP viscosity modifier involves free radical addition of the nitrogen-containing polar moiety to the polymer backbone. The nitrogen-containing polar moiety can be attached to the polymer using a double bond within the polymer (i.e., the double bond of the diene portion of an EPDM polymer) or by reacting the polymer with a compound providing a bridging group containing a double bond (e.g., maleic anhydride as described, for example, in U.S. Pat. Nos. 3,316,177; 3,326,804; and carboxylic acids and ketones as described, for example, in U.S. Pat. No. 4,068,056), and subsequently derivatizing the functionalized polymer with the nitrogen-containing polar moiety. A more complete list of nitrogen-containing compounds that can be reacted with the functionalized OCP are described in U.S. Pat. Nos. 7,485,603; 7,786,057; 7,253,231; 6,107,257; and 5,075,383 and are available commercially (e.g., HITEC 5777 available from Afton Corporation and PA1160, a product of Dutch Staaten Minen).

Another particular example includes low ethylene olefin copolymers containing about 50 wt. % ethylene and having a number average molecular weight between 10,000 and 20,000 grafted with maleic anhydride and aminated with aminophenyldiamine and other dispersant amines.

Lubricating compositions of present invention can be prepared using the nitrogen-containing dispersants or stabilizers in an amount of from about 0.001 wt. % to about 2 wt. %, or from about 0.005 wt. % to about 1.5 wt. %, based on total weight of the lubricating composition. Alternatively, the nitrogen-containing dispersants or stabilizers can provide nitrogen to the lubricant composition in an amount on a weight basis of from about 0.00001 wt. % to about 0.02 wt. %, preferably from about 0.00005 wt. % to about 0.01 wt. % nitrogen.

Antiwear Agents

The lubricating composition of this invention can also optionally contain antiwear agents that act to further enhance the stability of the discontinuous phase. These antiwear agents are especially effective when used in combination with the dispersants or stabilizing agents. These antiwear agents can be added during the manufacturing process at relatively low levels, preferably along with the nitrogen-containing dispersants or stabilizers, to providing enhanced stability to the discontinuous phase. Particularly preferred antiwear agents are organic phosphorus compounds such as phosphines, phosphine oxides, phosphinites, phosphonites, phosphinates, phosphites, phosphonates, phosphates and phosphoroamidates.

Examples of the organic phosphines represented by $(R)_3P$ include tributylphosphine, trihexylphosphine, trioctylphosphin, tri(2-ethylhexyl)phosphine, trinonylphosphine, tridecylphosphine, trilaurylphosphine, trimyristylphosphine, tripalmitylphosphine, tristearylphosphin, trioleylphosphine, triphenylphosphine, tricresylphosphine and the like.

Examples of alkylidene bisphosphines represented by $(R)_2P—(CH_2)_n—P(R)_2$ include methylenebis(dibutylphosphine), methylenebis(dihexylphosphine), methylenebis(dioctylphosphine), methylenebis(di2-ethylhexylphosphine), methylenebis(dinonylphosphine), methylenebis(didecylphosphin), methylenebis(dilauryphosphine), methylenebis(dimyristylphosphine), methylenebis(dipalmitylphosphine), methylenebis(distearyphosphine), methylenebis (dioleylphosphine), methylenebis(diphenylphosphin), methylenebis(dicresylphosphine) and the like.

Examples of the organic phosphine oxides represented by $(R)_3P{=}O$ include tributylphosphine oxide, trihexylphosphine oxide, trioctylphosphine oxide, tri(2-ethylhexyl)phosphine oxide, trinonylphosphine oxide, tridecylphosphine oxide, trilaurylphosphine oxide, trimyristylphosphine oxide, tripalmitylphosphine oxide, tristearylphosphine oxide, trioleylphosphine oxide, triphenylphosphine oxide, tricresylphosphine oxide and the like.

Examples of the organic phosphites represented by $(RO)_3P$ include mono, di, or tri-butyl phosphite (hereinafter "mono, di, or tri" is referred to as "mono/di/tri"), mono/di/trihexyl phosphite, mono/di/trioctyl phosphite, mono/di/tri(2-ethylhexyl)phosphite, mono/di/trinonyl phosphite, mono/di/tridecyl phosphite, mono/di/trilauryl phosphite, mono/di/trimyristyl phosphite, mono/di/tripalmityl phosphite, mono/di/tristearyl phosphite, mono/di/trioleyl phosphite, mono/di/triphenyl phosphite, mono/di/tricresyl phosphite and the like. Other phosphites include pentaerythritol diphosphite, pentaerythritol tetraphosphite, alkylidene bisphosphite and the like.

Examples of the organic phosphates represented by $(RO)_3P{=}O$ include triaryl phosphates (wherein aryl refers to one or more 5 or 6 membered aromatic rings, in which any one or more ring can be substituted by one or more of S, N or O), mono/di/tri-butyl phosphate, mono/di/trihexyl phosphate, mono/di/trioctyl phosphate, mono/di/tri(2-ethylhexyl) phosphate, mono/di/trinonyl phosphate, mono/di/tridecyl phosphate, mono/di/trilauryl phosphate, mono/di/trimyristyl phosphate, mono/di/tripalmityl phosphate, mono/di/tristearyl phosphate, mono/di/trioleyl phosphate, mono/di/triphenyl phosphate, mono/di/tricresyl phosphate and the like. It may also include a phosphate having a polyoxyalkylene group, i.e., phosphate of lauryl alcohol ethylene oxide and/or propylene oxide adducts and the like. Particularly preferred examples of organic phosphates include triphenyl phosphate, trinaphthyl phosphate, diphenyl cresyl (e.g., Durad™ 90) and dicresyl phenyl phosphates, tricresyl phosphate, naphtyl diphenyl phosphate and triphenylphosphorotionate.

The mono- or di-phosphates are referred to as acidic phosphate esters and may be used by neutralizing with bases such as alkalis, amines and the like. Examples of alkalis include metal hydroxides such as lithium hydroxide, sodium hydroxide, potassium hydroxide, magnesium hydroxide, calcium hydroxide and the like. Examples of amines include ammonia; alkylamines such as methylamine, dimethylamine, ethylamine, diethylamine, (iso)propylamine, di(iso)propylamine, butylamine, hexylamine, octylamine, decylamine, dodecylamine, tridecylamine, cetylamine, coco alkylamine, soybean oil alkylamine, beef tallow alkylamine, oleylamine, stearylamine and the like; alkanolamines such as monoethanolamine, N-methyl monoethanolamine, N-ethyl monoethanolamine, diethanolamine, N-methyl diethanolamine, N-ethyl diethanolamine, triethanolamine, 2-amino-2-methyl-1-propanol, 2-amino-2-methyl-1,3-propandiol, aminoethyl ethanolamine, N,N,N',N'-tetrakis(hydroxyethyl)ethylenediamine, N,N,N',N'-tetrakis(2-hydroxypropyl) ethylenediamine and the like and alkylene oxide adducts thereof; N-long chain alkylalkanolamines such as N-butyl diethanolamine, N-hexyl diethanolamine, N-octyl diethanolamine, N-decyl diethanolamine, N-cocoylalkyl diethanolamine, N-soybean oil alkyl diethanolamine, N-beef tallow alkyl diethanolamine, N-oleyl diethanolamine, N-stearyl diethanolamine, N,N-dibutyl monoethanolamine, N,N-dihexyl monoethanolamine, N,N-dioctyl monoethanolamine, N,N-didecyl monoethanolamine, N,N-bis(cocoylalkyl)monoethanolamine, N,N-bis(soybean oil alkyl)monoethanolamine, N,N-bis(beef tallow alkyl)monoethanolamine, N-dioleyl monoethanolamine, N-distearyl monoethanolamine and the like and alkylene oxide adducts thereof. Examples of the phosphoroamidates include condensation products of the phosphates listed above and the amines listed above and the like.

Non-phosphorous additives can also be used as antiwear additives. One example of non-phosphorous additives includes sulfurized or sulfur-containing olefins. Sulfur-containing olefins can be prepared by sulfurization of various organic materials including aliphatic, arylaliphatic or alicyclic olefinic hydrocarbons containing from 3 to 30 carbon atoms, preferably from 3 to 20 carbon atoms. The olefinic compounds contain at least one non-aromatic double bond. Such compounds are defined by the formula:

$$R^3R^4C{=}CR^5R^6$$

where each of $R^3$-$R^6$ is independently hydrogen or a hydrocarbon radical. Preferred hydrocarbon radicals are alkyl or alkenyl radicals. Any two of $R^3$-$R^6$ can be connected so as to form a cyclic ring.

Polysulfides of thiophosphorous acids and thiophosphorous acid esters can also be used as antiwear additives. Alkylthiocarbamoyl compounds (bis(dibutyl)thiocarbamoyl, for example) in combination with a molybdenum compound (oxymolybdenum diisopropylphosphorodithioate sulfide, for example) and a phosphorous ester (dibutyl hydrogen phosphite, for example) an also be used as antiwear additives. Thiocarbamates can also be used as an antiwear additives. In particular, thiocarbamate/molybdenum complexes such as moly-sulfur alkyl dithiocarbamate trimer complex ($R{=}C_8$-$C_{18}$ alkyl) are useful antiwear agents.

Esters of glycerol can also used as antiwear agents. For example, mono-, di, and tri-oleates, mono-palmitates and mono-myristates can be used.

Lubricating compositions of this invention can be prepared using the antiwear agents in an amount of from about 0.01 wt. % to about 5 wt. %, or from about 0.05 wt. % to about 3 wt. %, based on total weight of the lubricating composition.

Methods of Making

The lubricant composition of this invention can be prepared by any method suitable for producing stable emulsions. As one example, the lubricant composition can be prepared by heating the low viscosity continuous phase base oil and the high viscosity discontinuous phase ester together to a temperature where they dissolve with agitation followed by cooling the mixture. A protocol for producing the lubricants can include the steps of combining lower viscosity and higher viscosity materials, heating the resulting mixture with simultaneous agitation to a temperature at which the fluids substantially dissolve. Heating can be at a temperature of from 20° C. to 100° C., preferably from 30° C. to 80° C., until the materials are substantially dissolved. The dissolved fluids are then cooled to a temperature at which the fluids separate into a continuous phase and a discontinuous phase. Cooling will involve a reduction in temperature from the heating temperature of at least 20° C., preferably at least 30° C., and preferably not below 0° C. or below 10° C. The formation of a continuous phase and a discontinuous phase at the cooling temperature can be referred to as an emulsion as well as a dispersion.

Microfluidization steps can be incorporated into the process for making the lubricant composition. Microfluidization can be carried out by any suitable microfluidizer for producing either emulsions or dispersions, and that is capable of reducing mean particle size of the discontinuous phase material. The primary forces for microfluidization are:

a. shear, involving boundary layers, turbulent flow, acceleration and change in flow direction;
b. impact, involving collision of the particles processed with solid elements of the microfluidizer, and collision between the particles being processed; and
c. cavitation, involving an increased change in velocity with a decreased change in pressure, and turbulent flow. An additional force can be attributed to attrition, i.e., grinding by friction.

M-110 series laboratory scale microfluidizers available from Microfluidics™, Newton, Mass., can be used according to this invention. These microfluidizers contain an air motor connected to a hydraulic pump, which circulates the process fluid, i.e., the cooled emulsion or dispersion. The fluid is propelled at high pressures (up to 23,000 psi) through a chamber that has fixed microchannels for focusing the fluid stream and accelerating it to a high velocity. Within the chamber the fluid is subjected to intense shear, impact and cavitation, all of which contribute to particle size reduction. After processing, the fluid stream is passed through a heat exchanger coil, and the fluid can be collected or recirculated through the machine. The heat exchanger and chamber can be externally cooled with a refrigerated circulating water bath.

Solvent displacement emulsification steps can also be incorporated into the process for making the lubricant composition. A "displacing solvent" can be defined as any solvent or mixture of solvents that has at least some miscibility with the discontinuous phase ester composition so that the discontinuous phase ester is replaced with the solvent when the discontinuous phase composition is contacted with continuous phase base oil. Preferably, the displacing solvent is a low viscosity ester of the type described in the Group V optional component above.

Lubricating Composition Characteristics

The lubricant composition of this invention has superior lubricating performance. This performance property can be observed in a point contact optical EHL film thickness measurement device in which EHL film thickness is measured as a function of temperature and dynamic viscosity (product of kinematic viscosity and density). EHL film thickness can be expressed as LP, the lubricant parameter, which is a product of the dynamic viscosity, $\eta_0$ (cP), and the pressure-viscosity coefficient, $\alpha$ ($psi^{-1}$), according to equation 1:

$$LP=10^{11}\eta_0\alpha \quad \text{(Eq. 1)}$$

As apparent from equation 1, film thickness is expected to increase upon increasing the values for dynamic viscosity or pressure-viscosity coefficient. LP is the lubricant contribution to film thickness in EHL contacts. The lubricant parameter (LP) concept is fully described in the industry publication *Mobil EHL Guidebook*, Fourth edition, Mobil Oil Corp., Technical Publications, Fairfax, Va., 1992, herein incorporated by reference.

The lubricant compositions of this invention can be considered a two phase lubricant, as it is comprised of a continuous phase and a discontinuous phase. It can be used as high performance automotive engine oils, general industrial lubricants, grease, various types of automotive or industrial gears oils, aviation lubricants, hydraulic fluids or lubricants, heat transfer fluids, insulating fluids.

The two phase lubricating composition preferably has a standard ISO grade of 15 to 3,200 and is used in industrial applications, such as industrial worm gears. It is particularly suited for standard ISO grades 15, 22, 32, 46, 68, 100, 150, 220, 320 and 460. However, in another embodiment, the lubricating composition has a corresponding SAE grade of SAE 75W-90, SAE 80W-90, or SAE 85W-90 to SAE 85W-250, and is used in automotive applications, such as automotive gears.

In one embodiment, the two phase lubricating composition has a kinematic viscosity of 20 cSt to 3,300 cSt at 40° C. and a corresponding ISO VG grade of 15 to 3,200. The lubricating compositions having the ISO VG grades of 15 to 3,200 are acceptable for use in industrial gear applications, such as steel on steel gears or steel on bronze gears.

In one embodiment, the two phase lubricating composition has a kinematic viscosity of from 4 cSt at 100° C. to 200 cSt at 100° C. In another embodiment, the lubricating composition has a kinematic viscosity of from 20 cSt at 100° C. to 100 cSt at 100° C. In yet another embodiment, the lubricating composition has a kinematic viscosity of from 50 cSt at 100° C. to 100 cSt at 100° C. The kinematic viscosity is measured according to the ASTM D445 standard test method.

In one embodiment, the two phase lubricating composition has a viscosity index (VI) of 80 to 300. In another embodiment, the lubricating composition has a viscosity index of 100 to 275. In yet another embodiment, the lubricating composition has a viscosity index of 120 to 250. The viscosity index is measured according to the ASTM D2270 standard test method.

The blended lubricating composition allows power to be efficiently transported through the machinery in which the lubricating composition is used, so that little power is wasted to friction or heat. The lubricating compositions of this invention can be tested for energy efficiency using a two stage gearbox. For example, a two stage helical gearbox with a 10:1 ratio can be hooked up to a 15 hp motor. The output shaft of the gear box should be left to freely spin. Oil is then to be circulated thru the gear box, preferably running under the following conditions:

| Time hrs | Sump Oil ° F. | Input Speed rpm |
|---|---|---|
| 3 | Ambient | 1200 |
| 3 | 160 | 1200 |
| 3 | 160 | 1500 |
| 3 | 160 | 1800 |
| 3 | 200 | 1200 |

-continued

| Time hrs | Sump Oil ° F. | Input Speed rpm |
|---|---|---|
| 3 | 200 | 1500 |
| 3 | 200 | 1800 |

The gear box input shaft torque can be measured using an in-line torquemeter. Two types of experiments are preferably run. In the first the temperature is allowed to equilibrate to demonstrate heat lost thru oil churning. In the second the temperature is fixed and energy required to turn the gears at fixed rpm levels measured. Data can be collected electronically and analyzed for power loss for the different lubricants tested. Thus, one aspect of this invention is directed to a method for reducing energy consumption in operating machinery. The method comprises adding the lubricating composition of this invention to the machine and operating the machinery.

The shear stability, viscosity, and other properties of the blended lubricating composition allows the machinery to employ lower operating temperatures, which leads to lower energy consumption and lower energy costs. The lower operating temperature also leads to less degradation of the machinery and seals due to heat, and thus provides a longer machine life and longer seal life.

EXAMPLES

Example 1

EHL Film Thickness of 0.5 wt % PTE in PAO p-THF ester (PTE) was used with a viscosity of 652 cSt at 100° C. and density 0.97 g/cc at room temperature. A PAO base oil having a viscosity of 8 cSt at 100° C. (PAO-8) was obtained from ExxonMobil Chemical Company. A 0.5 wt % dispersion of PTE in the PAO was prepared by weighing 1.5 g of PTE and 298.5 g of PAO into a 600 ml glass beaker. A 2 inch magnetic stirbar was placed in the beaker and the sample was mixed at a setting of 3.5 on a Corning Model PC/620 Stirrer/Hot Plate while it was heated to 65° C. and held at 65° C. for 30 minutes. The heat and stirring were turned off and the sample was allowed to cool to room temperature. The median droplet size of the resulting dispersion was determined to be 29.5 microns in a Horiba LA910 Light Scattering Particle Size Analyzer.

The film thickness of PTE, PAO and the 0.5 wt % dispersion of PTE in PAO-8 were measured in a PCS Instruments EHL Ultra Thin Film Measurement System at 80° C. and 20 Newtons of load. The measurement was made with a rotating glass disc and (driven) steel ball at speeds from 1.3 to 0.018 m/s and 0% slide/roll ratio. The results are shown in FIG. 1. The film thickness of the dispersion at the lower speeds is greater than that of PAO-8 implying concentration of PTE within the contact region between the steel ball and the glass disc. The percent of PTE in the contact can be estimated from the following equation:

$$\text{estimated \% dispersed phase in contact} = \frac{h_{DISP} - h_{PAO}}{h_{PTE} - h_{PAO}} \quad (100)$$

where $h_{DISP}$, $h_{PAO}$ and $h_{PTE}$ are EHL film thickness of the dispersion, PAO and PTE, respectively. By this equation the estimated percent of PTE in the contact is 18% at 0.02 m/s and 5.6% at 0.1 m/s.

Example 2

EHL Film Thickness of 0.5 wt % Esterex™ A51 Derived Complex Ester in PAO

Its viscosity was 186 cSt at 100° C. and density was 1.05 g/cc at room temperature. A 0.5 wt % dispersion of the Ester in PAO-8, having a viscosity of 8 cSt at 100° C., was prepared by the procedure described in Example 1. The median droplet size of the dispersion was 55.0 microns. Its film thickness was measured under the conditions described in Example 1 and is shown in FIG. 2. The estimated percent of ester in the contact, 39% at 0.02 m/s and 26% at 0.1 m/s, is much higher than the percent of PTE in Example 1. Higher viscosity esters would be expected to exhibit correspondingly higher film thicknesses.

Example 3

Influence of Emulsion Preparation Process on Effectiveness of Surfactant Stabilization Five solvent displacement emulsions were prepared as follows:

(1) 0.5 wt % Esterex™ A51 derived Complex Ester in PAO. A stock solution of 10 wt % of Esterex™ A51 derived Complex Ester was prepared in ExxonMobil Chemical Company low viscosity adipate ester diluent. 95.0 g of ExxonMobil Chemical Company SpectraSyn™ 6 was weighed into a 400 ml beaker. A 2.5 inch magnetic stirrer was placed in the bottom of the beaker. The SpectraSyn™ 6 was stirred at a setting of 4 on a Corning Stir\Hotplate (approximately 175 RPM). 6 ml (5.0 grams) of the Esterex™ A51 derived Complex Ester solution was added in a dropwise manner into the stirred SpectraSyn™ 6 through an 18 guage syringe needle positioned above the surface of the SpectraSyn™ 6 at a point halfway between the center of the vortex and the edge of the beaker. The addition rate of the Esterex™ solution controlled with a syringe pump was 0.9 ml/min. The temperature of the SpectraSyn™ 6 was 22.5° C. The median droplet size of the initial emulsion measured in a Horiba LA910 Light Scattering Particle Size Analyzer was 2.22 microns.

(2) 0.5 wt % Esterex™ A51 derived Complex Ester and 0.05 wt % Hitec 5777 in SpectraSyn™ 6 by Process 1. 0.05 g Hitec 5777 and 94.95 g of ExxonMobil Chemical Company SpectraSyn™ 6 were weighed into a 400 ml beaker. A 2.5 inch magnetic stirrer was placed in the bottom of the beaker. The solution was stirred at 225 RPM with a Corning Stir/Hotplate for 30 minutes while heating to 65° C. The solution was then cooled to room temperature. A stock solution of 10 wt % of Esterex™ A51 derived Complex Ester was prepared in ExxonMobil Chemical Company low viscosity adipate ester diluent. 6 ml (5.0 grams) of the Esterex™ A51 derived Complex Ester solution was added in a dropwise manner into the stirred solution (175 RPM) of SpectraSyn™ 6 and Hitec 5777 through an 18 guage syringe needle positioned above the surface at a point halfway between the center of the vortex and the edge of the beaker. The addition rate of the Esterex™ solution was 0.9 ml/min. The temperature of the SpectraSyn™ 6 was 22.5° C. The median droplet size of the resulting emulsion was 1.19 microns.

(3) 0.5 wt % Esterex™ A51 derived Complex Ester and 0.05 wt % Hitec 5777 in SpectraSyn™ 6 by Process 2. A stock solution of 10 wt % of Esterex™ A51 derived Complex Ester and 1 wt % Hitec 5777 was prepared in ExxonMobil Chemical Company low viscosity adipate ester diluent. 95.0 g of ExxonMobil Chemical Company SpectraSyn™ 6 was weighed into a 400 ml beaker. A 2.5 inch magnetic stirrer was placed in the bottom of the beaker. The solution was stirred at a setting of 4 on a Corning Stir\Hotplate (approximately 175 RPM). 6 ml (5.0 grams) of the Esterex™ A51 derived Complex Ester/Hitec 5777 solution was added in a dropwise manner into the stirred SpectraSyn™ 6 through an 18 guage syringe needle positioned above the surface at a point halfway between the center of the vortex and the edge of the beaker. The addition rate of the Esterex™ solution was 0.9 ml/min. The temperature of the SpectraSyn™ 6 was 22.5° C. The median droplet size of the resulting emulsion was 1.48 microns.

(4) 0.5 wt % Esterex™ A51 derived Complex Ester, 0.45 wt % Chemtura Durad 90 and 0.05 wt % Hitec 5777 in SpectraSyn™ 6 by Process 1. 0.05 g Hitec 5777 and 94.95 g of ExxonMobil Chemical Company SpectraSyn™ 6 were weighed into a 400 ml beaker. A 2.5 inch magnetic stirrer was placed in the bottom of the beaker. The solution was stirred at 225 RPM with a Corning Stir\Hotplate for 30 minutes while heating to 65° C. The solution was then cooled to room temperature. A stock solution of 10 wt % of Esterex™ A51 derived Complex Ester and 9 wt % Durad 90 was prepared in ExxonMobil Chemical Company low viscosity adipate ester diluent. 6 ml (5.0 grams) of the Esterex™ A51 derived Complex Ester/Durad 90 solution was added in a dropwise manner into the stirred SpectraSyn™ 6/Hitec 5777 solution (175 RPM) through an 18 guage syringe needle positioned above the surface at a point halfway between the center of the vortex and the edge of the beaker. The addition rate of the Esterex™ solution was 0.9 ml/min. The temperature of the SpectraSyn™ 6 was 22.5° C. The median droplet size of the resulting emulsion was 1.04 microns.

(5) 0.5 wt % Esterex™ A51 derived Complex Ester, 0.45 wt % Durad 90 and 0.05 wt % Hitec 5777 in SpectraSyn™ 6 by Process 2. A stock solution of 10 wt % of Esterex™ A51 derived Complex Ester, 9 wt % Durad 90 and 1 wt % Hitec 5777 was prepared in ExxonMobil Chemical Company low viscosity adipate ester diluent. 95.0 g of ExxonMobil Chemical Company SpectraSyn™ 6 was weighed into a 400 ml beaker. A 2.5 inch magnetic stirrer was placed in the bottom of the beaker and the SpectraSyn™ 6 was stirred at a setting of 4 on a Corning Stir\Hotplate (approximately 175 RPM). 6 ml (5.0 grams) of the Esterex™ A51 derived Complex Ester/Durad 90/Hitec 5777 solution was added in a dropwise manner into the stirred SpectraSyn™ 6 through an 18 guage syringe needle positioned above the surface at a point halfway between the center of the vortex and the edge of the beaker. The addition rate of the diluent solution was 0.9 ml/min. The temperature of the SpectraSyn™ 6 was 22.5° C. The median droplet size of the resulting emulsion was 1.56 microns.

Emulsions (2) through (5) contain 0.05 wt % Hitec 5777. In those prepared by Process 1, the Hitec 5777 is dissolved in the non-polar, SpectraSyn™ 6, phase. In those prepared by Process 2, it is dissolved in the polar, high viscosity Esterex™ A51 derived Complex Ester phase. The location of the Hitec 5777 strongly affects its ability to stabilize the emulsions as demonstrated in FIGS. 3 and 4. Emulsions (2) and (3) have the same composition, but are prepared by Process 1 and 2, respectively. The droplet size and light transmittance of Emulsion (2) are significantly lower than those of Emulsion (3). The Hitec 5777 is better able to stabilize the emulsions when it is in the non-polar, SpectraSyn™ 6 phase. Emulsions (4) and (5) have the same composition, and have been prepared by Process 1 and 2, respectively. Again, the droplet size and light transmittance of Emulsion (4) prepared by Process 1 are significantly lower than those of Emulsion (5) prepared by Process 2. Process 1 is preferred. It has been shown previously that the presence of Durad 90 in the polar Esterex™ A51 derived Complex Ester phase has beneficial effect on Hitec 5777 stabilization of Esterex™ A51 derived Complex Ester emulsions. Emulsion (4) is by far the most stable emulsion.

Example 4

Dynamic Stability of Emulsions of Esterex™ A51 Derived Complex Ester in SpectraSyn™ 6 with and without Stabilizing Agents Emulsions of 0.5 wt % Esterex™ A51 derived Complex Ester in SpectraSyn™ 6 with and without stabilizing agent were prepared by microfluidization (4XMF) and solvent displacement emulsification (SDE) techniques.

The microfluidized emulsion without surfactant was prepared as follows. Esterex™ derived A51 Complex Ester was used with a viscosity of 186 cSt at 100° C. and density was 1.05 g/cc at 15.4° C. SpectraSyn™ 6 was obtained from ExxonMobil Chemical Company. Its viscosity was 5.8 cSt at 100° C. and density was 0.827 g/cc at 15.4° C. A 0.5 wt % dispersion of Complex Ester in SpectraSyn™ 6 was prepared by weighing 2.0 g of Complex Ester and 398 g of SpectraSyn™ 6 into a 1000 ml glass beaker. A 3 inch magnetic stirbar was placed in the bottom of the beaker and the sample was mixed at a setting of 5 on a Corning Model PC/620 Stirrer/Hot Plate as it was heated to 65° C. and held at 65° C. for 30 minutes. The heat and stirring were then turned off and the sample was allowed to cool to room temperature. The median volume based droplet size of the resulting emulsion was determined to be 52.6 microns with a Horiba LA910 Light Scattering Particle Size Analyzer. The sample was then passed through a lab scale model 110T microfluidizer four times at 12,000 psi. The median droplet size was reduced to 2.20 microns. The microfluidized emulsions with stabilizing agent were prepared by the same procedure. One contained 0.05 wt % of a high nitrogen polyisobutylene succinic anhydride polyamine (PIBSA-PAM) dispersant, predissolved in SpectraSyn™ 6. The other contained 0.05 wt % Afton Hitec 5777, a low nitrogen containing amine grafted olefin copolymer, predissolved in the SpectraSyn™ 6. The median droplet size of the initial and microfluidized emulsions stabilized with PIBSA-PAM were 40.3 and 1.36 microns, respectively. The median droplet size of the initial and microfluidized emulsions stabilized with Hitec 5777 were 23.8 (check) and 2.10 microns, respectively.

The solvent displacement emulsion without stabilizing agent was made with a low viscosity ester diluent by the following procedure. A stock solution of 10 wt % of Esterex™ A51 derived Complex Ester was prepared in ExxonMobil Chemical Company low viscosity adipate ester diluent. The viscosity of the adipate ester was 5.2 cSt at 100° C. and density was 0.91 at 15.4° C. 95.0 g of ExxonMobil Chemical Company SpectraSyn™ 6 was weighed into a 400 ml beaker. A 2.5 inch magnetic stirrer was placed on the bottom of the beaker. The solution was stirred at a setting of 4 on a Corning Stir\Hotplate (approximately 175 RPM). 6 ml (5.0 grams) of the Esterex™ A51 derived Complex Ester solution was added in a dropwise manner into the stirred SpectraSyn™ 6 through an 18 guage syringe needle positioned above the surface of the emulsion at a point halfway between the center of the vortex and the edge of the beaker. The addition rate of the Esterex™ solution with a syringe pump was 0.9 ml/min. The temperature of the SpectraSyn™ 6 was 22.5° C. The median droplet size of the resulting emulsion measured with a Horiba LA910 Light Scattering Particle Size Analyzer was 2.36 microns. The solvent displacement emulsion with stabilizing agent was made by a similar procedure. 0.05 wt % Afton Hitec 5777 was dissolved in SpectraSyn™ 6 prior to addition of the Esterex™ A51 derived Complex Ester solution. The Esterex™ A51 derived Complex Ester solution contained an additional additive, Chemtura Durad 90 antiwear agent. The composition of the diluent solution was 10 wt % Esterex™ A51 derived Complex Ester, 9 wt % Durad 90 and 81 wt % of the diluent. 5.0 grams of the diluent solution was added in a dropwise manner at 0.9 ml/min to 95.0 grams of stirred SpectraSyn™ 6 solution containing Hitec 5777. The composition of the resulting emulsion was 0.5 wt % Esterex™ A51 derived Complex Ester, 0.05 wt % Hitec 5777 and 0.45 wt % Durad 90 in SpectraSyn™ 6. The median droplet size of the resulting emulsion was 1.37 microns.

All five emulsions were subjected to the following dynamic stability test. 100 ml of emulsion was added to a 250 ml glass beaker. A 2 inch magnetic stirbar was placed in the bottom of the beaker and the emulsion was stirred with a Corning Stir\Hotplate at a setting of 5 corresponding to 225 rpm for 30 minutes. The median droplet size of the emulsions was measured before and after the treatment and the results appear in Table 1 below. As can be seen from the table, the emulsions without stabilizing agent increased significantly in droplet size after 30 minutes of stirring while those with stabilizing agents remained close to their initial droplet size. This was true for emulsions prepared by both the microfluidization and solvent displacement techniques. Stabilizing agents can effectively reduce coalescence of oil-in-oil emulsion lubricants.

TABLE 1

Dynamic Stability of Emulsions with and without Stabilizing Agents

| Sample Composition | Emulsion Droplet Size, Microns | |
|---|---|---|
| | No stirring | 30 min stirring |
| 4XMF 0.5 wt % Complex Ester in PAO-6 | 2.20 | 18.41 |
| 4XMF 0.5 wt % Complex Ester and 0.05 wt % PIBSA-PAM in PAO-6 | 1.36 | 2.17 |
| 4XMF 0.5 wt % Complex Ester and 0.05 wt % Hitec 5777 in PAO-6 | 2.10 | 2.12 |
| SDE 0.5 wt % Complex Ester in PAO-6 | 2.36 | 16.0 |
| SDE 0.5 wt % Complex Ester, 0.05 wt % Hitec 5777 and 0.45 wt % Durad 90 in PAO-6 | 1.37 | 1.59 |

Example 5

EHL Performance of Stabilized Emulsions of Esterex™ A51 Derived Complex Ester in PAO The EHL performance of microfluidized Esterex™ A51 derived Complex Ester emulsions in PAO, having a viscosity of 8 cSt at 100° C., stabilized with PIBSA-PAM and Hitec 5777 was compared to that of an unstabilized emulsion.

Esterex™ A51 derived Complex Ester having a viscosity of 186 cSt at 100° C. and density was 1.05 g/cc at room temperature. PAO, having a viscosity of 8 cSt at 100° C. (PAO-8), was obtained from ExxonMobil Chemical Company. Its viscosity was 7.9 cSt at 100° C. and density was 0.833 g/cc at 15.4° C. A 0.5 wt % dispersion of Complex Ester in PAO-8 was prepared by weighing 2.0 g of Complex Ester and 398 g of PAO-8 into a 1000 ml glass beaker. A 3 inch magnetic stirbar was placed in the bottom of the beaker and the sample was mixed at a setting of 5 on a Corning Model PC/620 Stirrer/Hot Plate corresponding to 225 RPM as it was heated to 65° C. and held at 65° C. for 30 minutes. The heat and stirring were then turned off and the sample was allowed to cool to room temperature. The median droplet size of the resulting emulsion was determined to be 54.1 microns in a Horiba LA910 Particle Size Analyzer. The sample was then passed through a lab scale model 110T microfluidizer four times at 12,000 psi. The median droplet size was reduced to 1.72 microns.

Two additional emulsions were prepared in a similar manner. A microfluidized emulsion of 0.5 wt % Complex Ester in PAO-8 was prepared containing 0.05 wt % of PIBSA-PAM, dispersant. The median droplet size of the emulsion following microfluidization was 0.80 microns. The other emulsion contained 0.2 g (0.05 wt %) Hitec 5777 in addition to 2.0 g Complex Ester in PAO-8 and the median droplet size of the emulsion following microfluidization was 1.8 microns.

The EHL film thickness of the emulsions was measured in a PCS Instruments EHL Ultra Thin Film Measurement System at 80° C. and 20 Newtons of load. The measurement was made with a rotating glass disc and (driven) steel ball at speeds from 1.3 to 0.018 m/s and 0% slide/roll ratio. The results are shown in FIG. 5. The film thickness of the emulsion with 0.05 wt % PIBSA-PAM is much lower than that of the emulsion with no stabilizing agent and the emulsion stabilized with Hitec 5777. It is concluded that Hitec 5777 is a preferred stabilizing agent for emulsions of Esterex™ A51 derived Complex Ester because it does not itnterfere with EHL performance. Low nitrogen may be an important feature of effective stabilizing agents. Hitec 5777 contains 0.08 wt % nitrogen in comparison to 2 wt % in PIBSA-PAM.

Example 6

Synergistic Effect of Antiwear Additive on Stabilization of Esterex™ A51 Derived Complex Ester Emulsion with Hitec 5777

Three emulsions were prepared by the solvent displacement technique described in Example 5. One contained 0.5 wt % Esterex™ A51 derived Complex Ester in SpectraSyn™ 6. Another contained 0.5 wt % Esterex™ A51 derived Complex Ester and 0.05 wt % Hitec 5777 in SpectraSyn™ 6. The third contained 0.5 wt % Esterex™ A51 derived Complex Ester, 0.05 wt % Hitec 5777 and 0.45 wt % Durad 90 in PAO-6. A preblend of Durad 90 and Esterex™ A51 derived Complex ester in diluent was used to prepare the third emulsion as described in Example 5. The droplet size and percent lamp transmittance was measured over time with a Horiba LA910 Particle Size Analyzer to determine the stability of the emulsions. The results shown in FIGS. 6 and 7 reveal a rapid increase in droplet size and lamp transmittance for the emulsion without stabilizing additives. As droplets coalesce they tend to settle out of suspension due to the density difference between the polar and non-polar phase. The percent of transmitted light is a roughly linear measure of suspended phase concentration. Addition of Hitec 5777 to the second emulsion had a strong stabilizing effect. However, the small increase in droplet size resulted in settling loss of the emulsified phase over time as indicated by the strong increase light transmittance after 54 days. The emulsion containing Hitex 5777 in the SpectraSyn™ 6 and Durad 90 in the Complex Ester phase was by far the most stable. Droplet size and light transmittance remained nearly constant over the 54 day test period. It is concluded that there is a synegistic effect of the presence of Durad 90 antiwear agent in the Complex Ester phase on stabilization of these emulsions with Hitec 5777.

The principles and modes of operation of this invention have been described above with reference to various exemplary and preferred embodiments. As understood by those of skill in the art, the overall invention, as defined by the claims, encompasses other preferred embodiments not specifically enumerated herein.

What is claimed is:

1. A lubricant composition, comprising:

a continuous phase base oil that is comprised of a Group II, III, IV or GTL base stock or a blend of at least two of the Group II, III, IV or GTL base stocks, wherein the continuous phase base oil has, independently, a viscosity of from 1 to 100 cSt at 100° C.; and a discontinuous phase that is comprised of an ester composition having a mean average droplet size of from 0.01 microns to 20 microns, in which the ester composition is comprised of at least one ester compound having no ether linkages, and wherein the ester composition is comprised of a complex ester.

2. The lubricant composition of claim 1, wherein the continuous phase is comprised of a Group IV base stock.

3. The lubricant composition of claim 1, wherein the lubricant composition comprises from 0.1 wt % to 10 wt % of the discontinuous phase.

4. The lubricant composition of claim 1, wherein the continuous phase base oil is comprised of a blend of at least one of the Group II, III, IV or GTL base stocks and a Group V base stock.

5. The lubricant composition of claim 4, wherein the continuous phase base oil comprises a Group V base stock in an amount of not greater than 50 wt. %, based on total weight of the continuous phase base oil.

6. The lubricant composition of claim 1, wherein the continuous phase base oil comprises not greater than 5 wt % of a Group V base stock, based on total weight of the continuous phase base oil.

7. The lubricant composition of claim 1, wherein the ester composition has, independently, a viscosity greater than 100 cSt at 100° C.

8. The lubricant composition of claim 1, wherein the discontinuous phase has not greater than 10 wt. % ester having ether linkages, based on total independent weight of the discontinuous phase.

9. The lubricant composition of claim 1, wherein the ester composition is comprised of adipate ester.

10. The lubricant composition of claim 1, wherein the complex ester is formed from the reaction of three or more of the following compounds:

i. Monohydric aliphatic alcohols
ii. Monobasic aliphatic acids
iii. Aliphatic glycols or polyglycols
iv. Polyhydric aliphatic alcohols
v. Dibasic aliphatic acids, and
vi. Polybasic aliphatic acids where at least one polyfunctional alcohol and at least one polyfunctional acid are employed.

11. The lubricant composition of claim 1, wherein the lubricant composition further comprises at least one nitrogen-containing olefin polymer dispersant or stabilizing agent in an amount of from 0.001 wt, % to 2 wt. %, based on total weight of the lubricating composition.

12. The lubricant composition of claim 11, wherein the at least one nitrogen-containing olefin polymer dispersant or stabilizing agent is a polyamine-derivatized poly α-olefin.

13. The lubricant composition of claim 11, wherein the at least one nitrogen-containing olefin polymer dispersant or stabilizing agent is an olefin copolymer containing at least one dispersing group selected from the group consisting of alkyl amine, aryl amine, amide, a nitrogen-containing heterocyclic group and an ester group.

14. The lubricant composition f claim 11, wherein the lubricant composition further comprises at least antiwear agent in an amount of from 0.001 wt. % to 2 wt. %, based on total weight of the lubricating composition.

15. The lubricant composition of claim 14, wherein the antiwear agent is an organic phosphate.

16. The lubricant composition of claim 15, wherein antiwear agent is triaryl phosphate.

17. The lubricant composition of claim 1, wherein the continuous phase base oil has, independently, a sulfur content of not greater than 0.05 wt %, based on total weight of the continuous phase base oil.

18. The lubricant composition of claim 1, wherein the continuous phase base oil has, independently, a viscosity index of at least 100.

19. A method for reducing energy consumption in operating machinery, comprising:

adding to the machinery the lubricating composition of claim 1, and operating the machinery.

* * * * *